US007465003B2

(12) United States Patent
Ushinohama et al.

(10) Patent No.: US 7,465,003 B2
(45) Date of Patent: Dec. 16, 2008

(54) LIQUID EJECTOR AND LIQUID EJECTING METHOD

(75) Inventors: Iwao Ushinohama, Kanagawa (JP); Yuichiro Ikemoto, Kanagawa (JP); Kazuyasu Takenaka, Tokyo (JP); Takeo Eguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 318 days.

(21) Appl. No.: 10/533,691

(22) PCT Filed: Sep. 3, 2004

(86) PCT No.: PCT/JP2004/012857

§ 371 (c)(1),
(2), (4) Date: May 2, 2005

(87) PCT Pub. No.: WO2005/023547

PCT Pub. Date: Mar. 17, 2005

(65) Prior Publication Data

US 2006/0071979 A1 Apr. 6, 2006

(30) Foreign Application Priority Data

Sep. 3, 2003 (JP) ..... 2003-311625

(51) Int. Cl.
*B41J 29/38* (2006.01)

(52) U.S. Cl. ..... 347/11; 347/10; 347/61; 347/62; 347/56; 347/57

(58) Field of Classification Search ..... 347/56, 347/57, 61, 62, 10, 11
See application file for complete search history.

(56) References Cited

U.S. PATENT DOCUMENTS

| | | | | |
|---|---|---|---|---|
| 4,463,359 | A | 7/1984 | Ayata et al. | |
| 4,740,796 | A | 4/1988 | Endo et al. | |
| 5,172,139 | A | 12/1992 | Sekiya et al. | |
| 6,325,492 | B1 * | 12/2001 | Koitabashi et al. | 347/57 |
| 6,375,309 | B1 * | 4/2002 | Taneya et al. | 347/48 |
| 6,382,768 | B1 * | 5/2002 | Koitabashi et al. | 347/48 |

(Continued)

FOREIGN PATENT DOCUMENTS

| | | |
|---|---|---|
| JP | 2000-185403 | 7/2000 |

(Continued)

*Primary Examiner*—Manish S. Shah
*Assistant Examiner*—Laura E Martin
(74) *Attorney, Agent, or Firm*—Rockey, Depke & Lyons, LLC; Robert J. Depke

(57) ABSTRACT

The present invention is directed to a liquid discharge apparatus adapted for discharging inks from discharge holes, which includes a control unit for controlling a discharge control unit, wherein the control unit controls the discharge control unit in such a manner that pulse current delivered to one of a pair of heating resistors is caused to be reference, and pulse current is delivered to the other heating resistor in the state where timing is shifted in a time of the range within 20% of supply time of pulse current serving as reference with respect to supply timing of pulse current serving as reference. Thus, it is possible to suppress unevenness or variation of impact positions of ink droplets discharged in the state where discharge direction has been changed. As a result, deterioration of picture quality resulting from color tone unevenness and/or white stripe, etc. is prevented. Thus, print operation can be performed at excellent picture quality.

12 Claims, 22 Drawing Sheets

U.S. PATENT DOCUMENTS 6,464,329 B1 * 10/2002 Koitabashi et al. ..... 347/40
6,471,337 B1 * 10/2002 Inoue ..... 347/57
6,488,350 B2 * 12/2002 Iwasaki et al. ..... 347/12
6,913,345 B2 * 7/2005 Parish et al. ..... 347/53
6,918,656 B2 * 7/2005 Koitabashi et al. ..... 347/56
2007/0008380 A1 * 1/2007 Ushinohama et al. ..... 347/61

FOREIGN PATENT DOCUMENTS

JP 2001-105584 4/2001
JP 2001105584 A * 4/2001

* cited by examiner

SAMPLE 1 BUBBLE GENERATION TIME DIFFERENCE 0%

SAMPLE 2 BUBBLE GENERATION TIME DIFFERENCE 7.5%

SAMPLE 3 BUBBLE GENERATION TIME DIFFERENCE 13%

SAMPLE 4 BUBBLE GENERATION TIME DIFFERENCE 20%

SAMPLE 5 BUBBLE GENERATION TIME DIFFERENCE 21%

SAMPLE 6 BUBBLE GENERATION TIME DIFFERENCE 23%

LIQUID EJECTOR AND LIQUID EJECTING METHOD

This application is the National Phase filing of PCT/JP2004/012857, filed on Sep. 3, 2004, and claims priority of Japanese Patent Application No. JP2003-311625, filed Sep. 3, 2003, which is incorporated herein by reference.

TECHNICAL FIELD

The present invention relates to a liquid discharge apparatus and a liquid discharge method which are adapted for discharging droplets from discharge holes.

This Application claims priority of Japanese Patent Application No. 2003-311625, filed on Sep. 3, 2003, the entirety of which is incorporated by reference herein.

BACKGROUND ART

Hitherto, as an apparatus adapted for discharging liquid, there are liquid discharge apparatuses of the ink jet type system which are adapted for discharging inks which are liquid from liquid discharge portions with respect to a recording paper as object to record images and/or characters.

The liquid discharge apparatuses using ink jet system have the merits that running cost is low, and miniaturization of the apparatus and realization of color print image are easy.

In the liquid discharge apparatuses using ink jet system, inks of yellow, magenta, cyan and black, etc. are delivered from ink cartridge to ink liquid chambers of liquid discharge portion, etc. The inks which have been delivered to the ink liquid chambers, etc. are pressed by pressure generated by pressure generating or producing element such as heating resistor, etc. disposed within the ink liquid chamber. As a result, inks within the ink liquid chambers are discharged from very small ink discharge holes, so-called nozzles provided at the liquid discharge portion. In concrete terms, inks within the ink chamber are heated by heating resistor disposed within the ink liquid chamber to produce bubbles at inks on the heating resistor. By pressure produced by bubbles, inks are discharged from the nozzles to hit the inks which have been discharged onto recording paper as object, etc. to print images and/or characters.

As a liquid discharge apparatus employing the ink jet system, there is a printer apparatus of the serial type in which ink cartridge is loaded or attached to liquid discharge head and the liquid discharge head is moved in width direction of the recording paper, i.e., in a direction substantially perpendicular to carrying direction of the recording paper to thereby hit inks of predetermined colors onto the recording paper. Moreover, there is a liquid discharge apparatus of the so-called line head type in which substantially the same range as width of the recording paper is caused to be discharge range of the ink, i.e., inks are discharged from nozzles of liquid discharge portions arranged in width direction of the recording paper.

In the liquid discharge apparatus of the serial type, when the liquid discharge head is moved in a direction substantially perpendicular to carrying direction of the recording paper, traveling operation of the recording paper is stopped to discharge inks with respect to the recording paper in a stop state while moving the liquid discharge head to repeat such discharge operation to thereby perform print operation. On the other hand, in the liquid discharge apparatus of the line head type, the liquid discharge head is generally fixed to discharge inks from the liquid discharge head with respect to continuously traveling recording paper to hit those inks to thereby perform print operation. For this reason, since the liquid discharge apparatus of the line head type is adapted so that the liquid discharge head is not moved unlike the liquid discharge apparatus of the serial type, it becomes possible to perform high speed print operation as compared to the printer apparatus of the serial type.

Moreover, in the liquid discharge apparatus of the line head type, because it is unnecessary to move the liquid discharge head, respective ink cartridges can be enlarged. As a result, ink capacity of the ink cartridge can be increased. In such liquid discharge apparatus of the line head type, since the liquid discharge head is not moved, simplification of the configuration can be realized. Thus, it becomes possible to integrally provide respective ink cartridges and liquid discharge head.

Meanwhile, in the above-described liquid discharge apparatus of the line head type, print accuracy of image and/or character, etc. depend upon accuracy of the timing at which ink is hit onto traveling recording paper. Explanation will be given in concrete terms. There takes place the problem that when, e.g., traveling speed of the recording paper is high, print operation is performed in the state where recorded images and/or characters, etc. are expanded in carrying direction of the recording paper, and while when traveling speed of the recording paper is low, print operation is performed in the state where recorded images and/or characters, etc. are contracted in carrying direction of the recording paper.

In order to solve such problem, in the liquid discharge apparatus of the line head type, e.g., servo motor, etc. is used for control of motor for traveling recording paper, etc. Namely, traveling speed is caused to be constant so that unevenness does not take place in traveling speed of the recording paper to thereby control the timing at which ink is hit onto the recording paper.

Even in the case where servo motor as described above, etc. is used, while expansion and/or contraction of image, etc. are eliminated, there is the possibility that when there slightly exists error of several microns at impact timing of ink onto the recording paper, color tone unevenness, i.e., unevenness of density of color may take place in carrying direction of the recording paper. In concrete terms, when control of traveling speed of the recording paper by servo motor is delayed slightly by several microns, color tone becomes thick at this portion. On the other hand, when control of the traveling speed of the recording paper by the servo motor becomes fast slightly by several microns, color tone becomes thin at this portion. Further, when control of traveling speed of the recording paper becomes fast at level of several ten microns or several hundred microns, there take place a portion in which no ink is hit, i.e., so-called white stripe would take place over the range in a direction substantially perpendicular to carrying direction of the recording paper.

On the other hand, in the liquid discharge apparatus of the serial type, in stopping traveling operation of the recording paper to perform print operation, print operation in which so-called overlap portion is provided is performed in such a manner that the previous print portion and current print portion overlap with each other within a predetermined range at the boundary portion thereof to thereby prevent color tone unevenness or white stripe from taking place in carrying direction of the recording paper. In the liquid discharge apparatus of the serial type, color tone unevenness and/or white stripe, etc. can be suppressed, but there is the problem that the above-mentioned overlap portion is provided so that time required for print operation is elongated, and/or quantity of ink used for print operation is increased.

In order to solve problems as described above, it is proposed in the Japanese Patent Application Laid Open No.

2000-185403 publication that there is employed (used) such a configuration disclosed in the U.S. Pat. No. 5,172,139 specification, i.e., the configuration in which plural heating resistors are provided so that they are face-symmetrical with each other at a plane including center line of nozzle at a position opposite to nozzle of the liquid discharge portion which discharges inks to allow heat quantities of respective heating resistors to be different from each other to thereby control discharge direction of ink.

In the case of the configuration disclosed in the Japanese Patent Application Laid Open No. 2000-185403 publication, in the case where heat quantities of respective heating resistors are not suitable, ink might not be discharged in a desired discharge direction. As a result, picture quality may be lowered. In practical sense, as in a liquid discharge portion (element) 201 shown in FIG. 22, in the case where energies delivered to the respective heating resistors 202 are not suitable, balance of size of bubbles 204, etc. that the respective heating resistors 202 produce at ink 203 becomes poor. Namely, in this liquid discharge portion 201, there is the possibility that balance of pressure for pressing ink 203 on respective heating resistors 202 becomes unstable so that discharge direction of ink may be diverse.

Moreover, in the liquid discharge portion 201, in the case where balance of pressure for pressing ink 203 on respective heating resistors 202 becomes unstable, there are instances where discharge angle θ of ink droplet i from the nozzles 205 becomes too small. In this case, in the liquid discharge portion 201, since discharge angle θ of ink droplet i becomes too small, ink droplet i comes into contact with edge portion 205*a* of the nozzle 205 when the ink droplet i is discharged from the nozzle 205. Further, the discharge direction is caused to be diverse.

From the above-mentioned facts, in the discharge portion (head) 201, there are instances where impact point is shifted when ink droplet i is hit upon the principal surface of the recording paper P, and color tone unevenness and/or white stripe, etc. take place so that picture quality may be lowered.

In view of the above, in the liquid discharge portion 201, it is important to suitably control heat quantities of respective heating resistors 202 for discharging ink droplet i from the nozzle 205, i.e., energy quantities, etc. such as current, etc. delivered to respective heating resistors 202 for the purpose of heating respective heating resistors 202.

DISCLOSURE OF THE INVENTION

Problems to be Solved by the Invention

An object of the present invention is to provide a novel liquid discharge apparatus and a novel liquid discharge method which can eliminate problems that prior arts as described above have.

Another object of the present invention is to provide a liquid discharge apparatus and a liquid discharge method which are adapted for preventing pressure balance for pressing liquid produced by respective pressure generating elements from being uncontrollable to thereby have ability to prevent lowering of picture quality.

The liquid discharge apparatus according to the present invention comprises discharge control means including a liquid chamber for storing liquid therewithin, two pressure generating elements or more provided at the liquid chamber and serving to press liquid stored within the liquid chamber, and discharge holes for discharging liquid which has been pressed by the respective pressure generating elements in the state of droplet from the liquid chamber thus to control supply timings and supply times of energies to respective pressure generating elements to control discharge angle when droplet is discharged from the discharge hole. Here, the discharge control means is adapted so that, with energy delivered to one of the respective pressure generating elements being as reference, the discharge control means delivers energy to the other pressure generating element in the state where timing is shifted in a time of the range within 20% of supply time of energy serving as reference with respect to supply timing of energy serving as reference.

The liquid discharge apparatus according to the present invention is adapted to deliver energy to other pressure generating element at a timing which is substantially the same as reference energy, or delivers energy thereto in the state where time is shifted within the range of 20% of the time period during which reference energy is delivered with respect to reference energy so that energy is delivered to respective pressure generating elements at a suitable timing. Thus, it is possible to discharge liquid in a desired direction from the discharge hole.

The liquid discharge method according to the present invention is directed to a liquid discharge method for a liquid discharge apparatus including a liquid chamber for storing liquid therewithin, two pressure generating elements or more provided at the liquid chamber and serving to press liquid stored within the liquid chamber, and discharge holes for discharging liquid which has been pressed by the respective pressure generating elements in the state of droplet from the liquid chamber, wherein energy delivered to one of respective pressure generating elements is caused to be reference, and energy is delivered to the other pressure generating element in the state where timing is shifted in a time of the range within 20% of supply time of energy serving as reference with respect to supply timing of energy serving as reference to control discharge angle when the droplet is discharged from the discharge hole.

In the liquid discharge method according to the present invention, energy is delivered to other pressure generating element at a timing which is substantially the same as that of reference energy, or energy is delivered thereto in the state where time is shifted in the range within 20% of time period during which reference energy is delivered with respect to reference energy so that energy is delivered, at a suitable timing, to respective pressure generating elements. From this fact, it is possible to discharge droplet from discharge hole toward a desired direction.

In accordance with the liquid discharge apparatus and the liquid discharge method according to the present invention, shift of impact point of discharged droplet is also suppressed. Thus, print operation having excellent picture quality can be performed.

Still further objects of the present invention and practical merits obtained by the present invention will become more apparent from the description of the embodiments which will be given below with reference to the attached drawings.

BRIEF DESCRIPTION OF THE DRAWINGS

FIGS. 4A and 4B show an ink supply portion when ink cartridge is loaded into ink jet print head cartridge, wherein FIG. 4A is a model view showing the state where the supply hole is closed, and FIG. 4B is a model view showing the state where the supply hole is opened.

FIGS. 6A and 6B show valve mechanism at connection portion of ink cartridge, wherein FIG. 6A is a cross sectional view showing the state where the valve is closed, and FIG. 6B is a cross sectional view showing the state where the valve is opened.

FIGS. 16A to 16C show that discharge control unit controls discharge direction of ink droplet, wherein FIG. 16A is a cross sectional view showing that ink droplet is discharged toward the direction of the portion positioned substantially immediately below, FIG. 16B is a cross sectional view showing the state where ink droplet is discharged in one substantially oblique direction of width direction of recording paper with nozzle being as center, and FIG. 16C is a cross sectional view for explaining the state where ink droplet is discharged in other substantially oblique direction of width direction of recording paper with nozzle being as center.

FIGS. 18A to 18F are model views showing impact points of ink droplet discharged from the nozzle when pulse current is delivered to a pair of heating resistors at ink discharge head in the state where timing is shifted, wherein FIG. 18A shows impact points when shift quantity of current supply timing is 0%, FIG. 18B shows impact points when shift quantity of current supply timing is 7.5%, FIG. 18C shows impact points when shift quantity of current supply timing is 13%, FIG. 18D shows impact points when shift quantity of current supply timing is 20%, FIG. 18E shows impact points when shift quantity of current supply timing is 21%, and FIG. 18F shows impact points when shift quantity of current supply timing is 23%.

FIGS. 21A to 21C show other examples of ink discharge head, wherein FIG. 21A is a plan view showing the state where heating resistors are arranged in parallel in carrying direction of recording paper, FIG. 21B is a plan view showing the state where three heating resistors are provided within ink chamber, and FIG. 21C is a plan view showing the state where four heating resistors are provided within the ink chamber.

BEST MODE FOR CARRYING OUT THE INVENTION

A liquid discharge apparatus and a liquid discharge method according to the present invention will now be explained with reference to the attached drawings.

Figure 1:
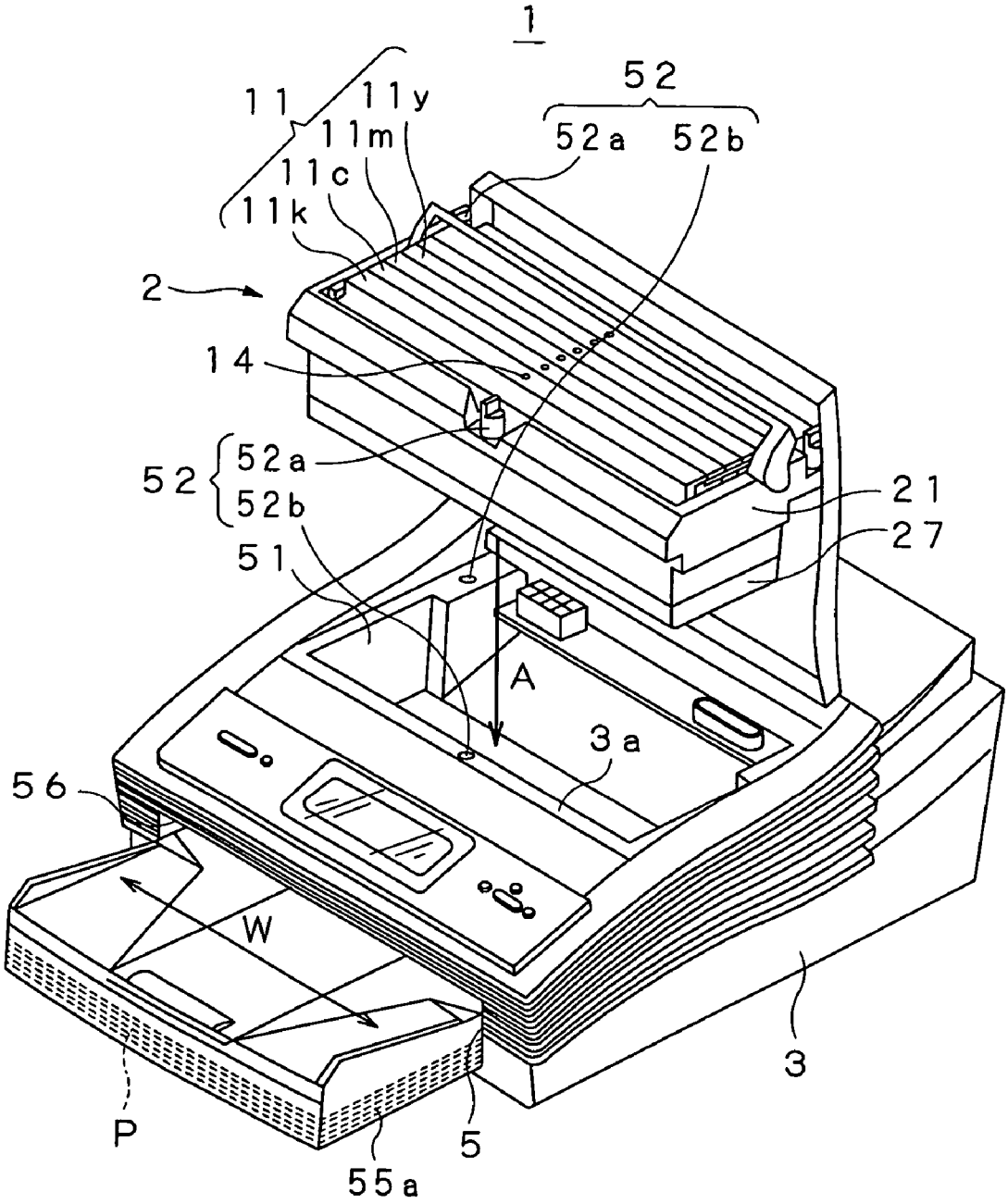
FIG. 1 is a perspective view showing a liquid discharge apparatus according to the present invention.

As shown in FIG. 1, a printer apparatus 1 which is a liquid discharge apparatus of the ink jet system to which the present invention is applied serves to discharge inks, etc. with respect to recording papers P traveling in a predetermined direction to print images and/or characters. The printer apparatus 1 is directed to the printer apparatus of the so-called line head type in which ink discharge holes (nozzles) are arranged in parallel in substantially line form in width direction of recording paper P, i.e., in a direction indicated by arrow W in FIG. 1 in correspondence with print width of the recording paper P.

The printer apparatus 1 according to the present invention comprises an ink jet print head cartridge (hereinafter referred to as unit head cartridge) 2 for discharging ink 4, and a printer body 3 for loading or attaching the head cartridge 2. In the printer apparatus 1, the head cartridge 2 is detachable with respect to the printer body 3, and ink cartridges 11*y*, 11*m*, 11*c*, 11*k* serving as ink supply source are further detachably loaded with respect to the head cartridge 2. In the printer apparatus 1, ink cartridge 11*y* within which yellow ink is filled, ink cartridge 11*m* within which magenta ink is filled, ink cartridge 11*c* within which cyan ink is filled, and ink cartridge 11*k* within which black ink is filled can be used. In addition, the head cartridge 2 detachable with respect to the printer body 3, and ink cartridges 11*y*, 11*m*, 11*c*, 11*k* detachable with respect to the head cartridge 22 are caused to be as consumable supplies.

In such printer apparatus 1, a tray 55*a* for accommodating recording papers P in a stacked manner is loaded at a tray loading unit 5 provided at the bottom surface side of the front face of the printer body 3, thereby making it possible to feed or deliver recording papers P accommodated within the tray 55*a* into the printer body 3. When the tray 55*a* is loaded into the tray loading unit 5 of the front face of the printer body 3, recording paper P is fed from a paper feed hole 55 toward the rear surface side of the printer body 3 by a paper feed/eject mechanism (see FIG. 13). The carrying direction of the recording paper P which has been sent toward the rear surface side of the printer body 3 is inverted by inverting roller 83 (see FIG. 13). Thus, the recording paper P is sent from the rear surface side of the printer body 3 toward the front surface side thereof at the upper side of outgoing path. For a time period until recording paper P sent from the rear surface side of the printer body 3 toward the front surface side is ejected from a paper eject hole 56 provided at the front surface of the printer body 3, print data corresponding to character data and/or image data inputted from an information processing unit (processor) 69 such as personal computer, etc. (see FIG. 14) are printed as characters and/or images onto the recording paper P.

The head cartridge 2 for performing print operation with respect to recording paper P is loaded from the upper surface side of the printer body 3, i.e., from the direction indicated by arrow A in FIG. 1 to discharge ink 4 with respect to the recording paper P traveling by the paper feed/eject mechanism 54 to perform print operation. In this example, the head cartridge 2 detachable with respect to the printer body 1 constituting the above-described printer apparatus 1 and ink cartridges 11*y*, 11*m*, 11*c*, 11*k* detachable to the head cartridge 2 will be first explained with reference to the attached drawings.

Figure 2:
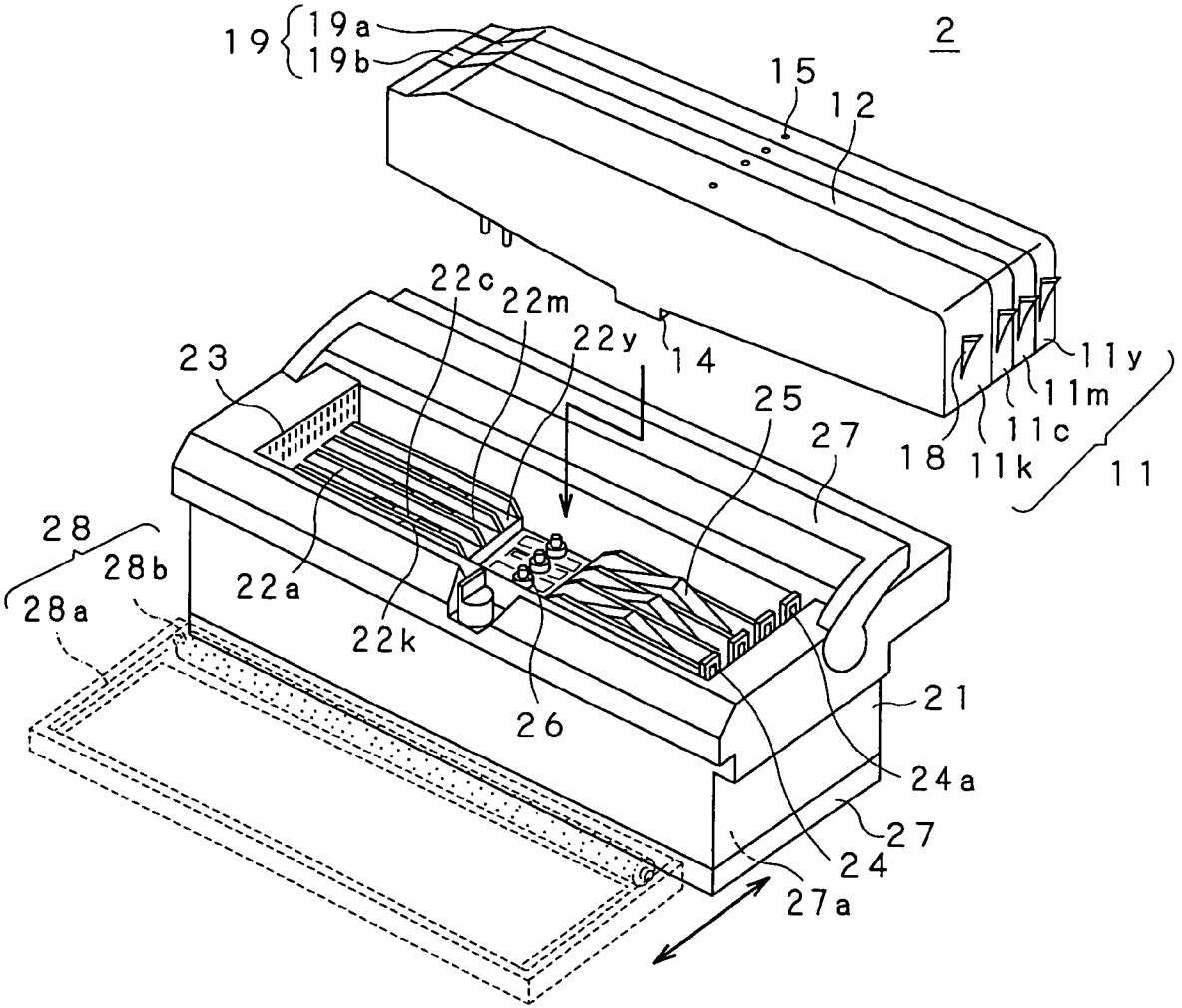
FIG. 2 is a perspective view showing ink jet print head cartridge used in the liquid discharge apparatus.
Figure 3:
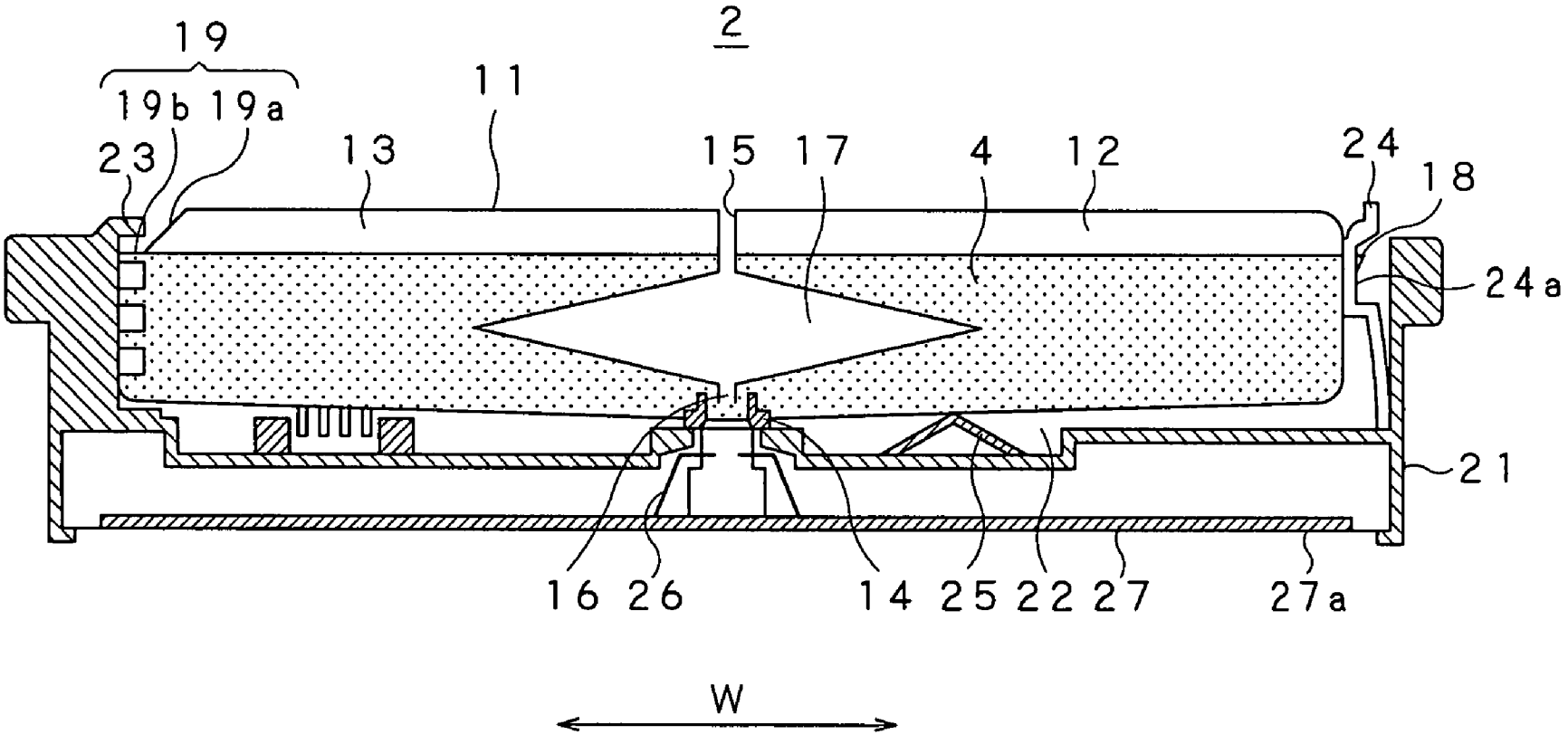
FIG. 3 is a cross sectional view showing ink jet print head cartridge.

The head cartridge 2 serves to change ink 4 serving as conductive liquid into fine particles by pressure that pressure generating or producing means using, e.g., electrical-thermal transform system or electrical-mechanical transform system, etc. to discharge the liquid in particle form to spray them in the state of droplet onto the principal surface of object such as recording paper P, etc. In concrete terms, as shown in FIGS. 2 and 3, the head cartridge 2 includes a cartridge body 21, wherein ink cartridges 11*y*, 11*m*, 11*c*, 11*k* serving as vessel within which ink 4 is filled are loaded with respect to the cartridge body 21. It is to be noted that, in the following description, ink, cartridges 11*y*, 11*m*, 11*c*, 11*k* will be simply referred to as ink cartridge 11 as occasion may demand.

As shown in FIG. 3, the ink cartridge 11 detachable to the head cartridge 2 includes a cartridge vessel 12 molded by injection-molding resin material, etc. such as polypropylene, etc. having strength and/or ink resistance characteristic. The cartridge vessel 12 is formed so as to take substantially rectangular shape in which size in length direction is caused to be the same size as that of width direction of recording paper P used, and is caused to be of the configuration to increase, as large as possible, ink capacity stored therewithin.

In concrete terms, at the cartridge vessel 12 constituting the ink cartridge 11, there are provided an ink accommodating portion 13 for accommodating ink 4, an ink supply portion 14 for supplying ink 4 from the ink accommodating portion 13 to the cartridge body 21 of the head cartridge 2, an external communicating hole 15 for taking air from the external into the ink accommodating portion 13, an air introduction path 16 for introducing air which has been taken from the external communication hole 15 into the ink accommodating portion 13, a storage portion 17 for temporarily storing ink 4 between the external communicating hole 15 and the air introduction path 16, and a holding projection portion 18 and an engagement step portion 19 for holding the ink cartridge 11 at the cartridge body 21.

The ink accommodating portion 13 forms a space for accommodating ink 4 by material having high sealing property. The ink accommodating portion 13 is formed so as to take substantially rectangular shape, and is formed so that size in length direction is caused to be substantially the same size as size of width direction of the recording paper P used, i.e., width direction W of the recording paper P shown in FIG. 3.

The ink supply portion 14 is provided substantially at the central portion of the lower side of the ink accommodating portion 13. The ink supply portion 14 is nozzles in substantially projection shape, which communicates with the ink accommodating portion 13, and the front end of the nozzle is fitted into the connecting unit 26 of the head cartridge 2 which will be described later to thereby connect the cartridge vessel 12 of the ink cartridge 2 and the cartridge body 21 of the head cartridge 2.

Figure 4A:
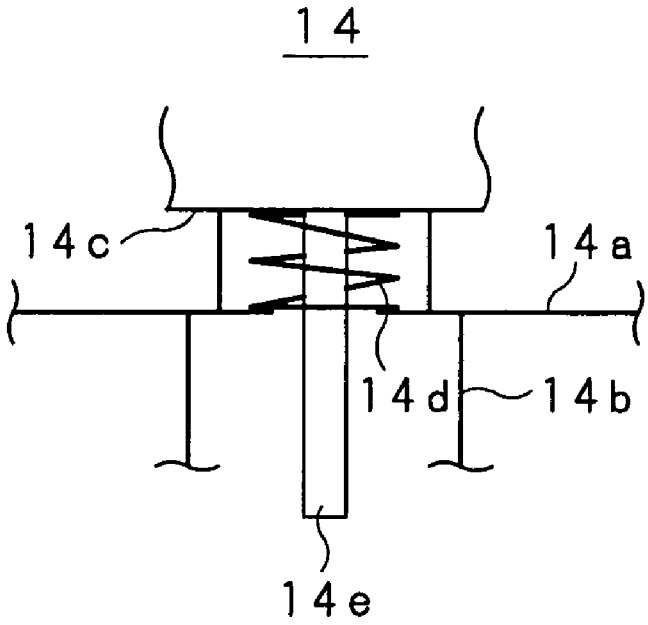
Figure 4B:
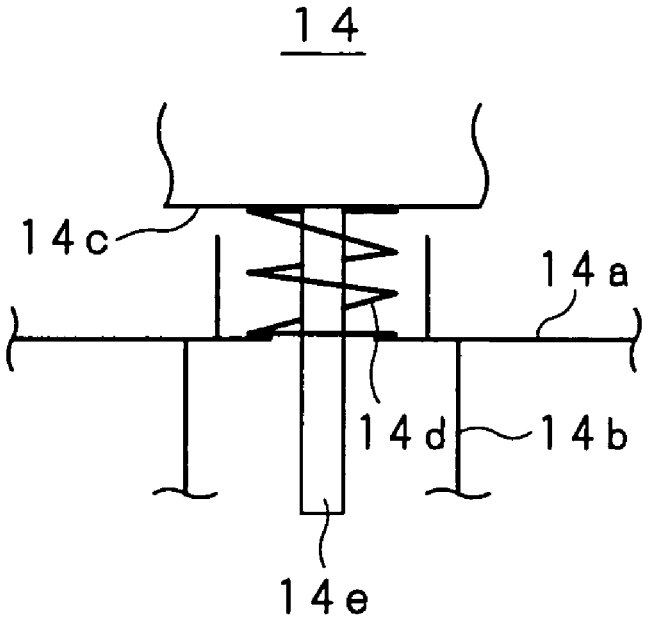

At the ink supply portion 14, as shown in FIGS. 4A and 4B, there is provided a supply hole 14*b* for supplying ink 4 onto bottom surface 14*a* of the ink cartridge 11. At the bottom surface 14*a*, there are provided a valve 14*c* for opening/closing the supply hole 14*b*, a coil spring 14*d* for biasing the valve 14*c* in a direction to close the supply hole 14*b*, and an opening/closing pin 14*e* for opening/closing the valve 14*c*. At the supply hole 14*b* for supplying ink 4, which is connected to the connecting portion 26 of the head cartridge 2, as shown in FIG. 4A, the valve 14*c* is biased and closed in a direction to close the supply hole 14*b* by biasing force of the coil spring 14*d* serving as biasing member at the stage before the ink cartridge 11 is loaded into the cartridge body 21 of the head cartridge 2. Further, when the ink cartridge 11 is loaded into the cartridge body 21, the opening/closing pin 14*e* is pushed upward in a direction opposite to biasing direction of the coil spring 14*d* by the upper portion of the connecting portion 26 of the cartridge body 21 constituting the head cartridge 2. Thus, the opening/closing pin 14*c* which has been pushed upwardly pushes the valve 14*c* upwardly against biasing force of the coil spring 14*d* to open the supply hole 14*b*. In a manner as stated above, the ink supply portion 14 of the ink cartridge 11 is connected to the connecting portion 26 of the head cartridge 2 to allow the ink accommodating portion 13 and ink storage portion 31 to communicate with each other so that there results the state where supply of ink 4 to the ink cartridge portion 31 can be made.

Moreover, when the ink cartridge 11 is pulled (drawn) out from the connecting portion 26 of the head cartridge 2 side, i.e., the ink cartridge 11 is detached from the loading portion 22 of the head cartridge 2, pushing-up state by the opening/closing pin 14*e* of the valve 14*c* is released. As a result, the valve 14*c* is moved in a biasing direction of the coil spring 14*d* to close the supply hole 14*b*. Thus, immediately before the ink cartridge 11 is loaded into the cartridge body 21, it is possible to prevent ink 4 within ink accommodating portion 13 from being leaked even in the state where the front end portion of the ink supply portion 14 is directed downwardly. Further, when the ink cartridge 11 is pulled (drawn) out from the cartridge body 21, since the valve 14*c* immediately closes the supply hole 14*b*, it is possible to prevent ink 4 from being leaked from the front end of the ink supply portion 14.

As shown in FIG. 3, an external communicating hole 15 is a ventilation hole for taking air from the ink cartridge 11 external into the ink accommodating portion 13. Also when the ink cartridge 11 is loaded into the loading portion 22 of the head cartridge 2, the external communicating hole 15 is provided at the upper surface, i.e., at substantially the center of the upper surface of the cartridge vessel 12 which is the position facing to the external at the time of loading with respect to the loading portion 22. When the ink cartridge 11 is loaded at the cartridge body 21 so that ink 4 flows downwards from the ink accommodating portion 13 toward the cartridge body 21 side, the external communicating hole 15 takes air corresponding to the quantity that ink 4 within the ink accommodating unit 13 is decreased from the external into the ink cartridge 11.

An air introduction path 16 allows the ink accommodating portion 13 and the external communicating hole 15 to communicate with each other to introduce air which has been taken in from the external communicating hole 15 into the ink accommodating portion 13. Thus, when the ink cartridge 11 is loaded at the cartridge body 21, even if ink is delivered to the cartridge body 21 of the head cartridge 2 so that ink 4 within the ink accommodating portion 13 is decreased and the inside thereof is placed in decompressed state, air is introduced to the ink accommodating portion 13 by the air introduction path 16. From this fact, the internal pressure is kept in equilibrium state thus to have ability to suitably deliver ink 4 to the cartridge body 21.

The storage portion 17 is provided between the external communicating hole 15 and the air introduction path 16, and serves to temporarily store ink 4 so that ink 4 does not suddenly flow out to the external when ink 4 is leaked from the air introduction path 16 communicating with the ink accommodating portion 13. The storage portion 17 is formed so as to take substantially diamond shape in which longer diagonal line is caused to be length direction of the ink accommodating portion 13, and is adapted so that the air introduction path 16 is provided at the summit portion positioned at the lowest side of the ink accommodating portion 13, i.e., at the lower side on the shorter diagonal line. Thus, ink 4 admitted from the ink accommodating portion 13 can be returned to the ink accommodating portion 13 for a second time.

A holding projecting portion 18 is a projection provided at one side surface of short side of the ink cartridge 11, and is engaged with an engagement hole 24*a* formed at a latch lever 24 of the cartridge body 21 of the head cartridge 2. The holding projecting portion 18 is adapted so that the upper surface thereof is formed at such a plane substantially perpendicular to the side surface of the ink accommodating portion 13, and the lower surface thereof is formed in a manner inclined from the side surface toward the upper surface.

An engagement step portion 19 is provided at the upper portion of the side surface opposite to the side surface where the engagement projection 18 is provided of the ink cartridge 11. The engagement step portion 19 is composed of an inclined surface 19*a* of which one end is in contact with the upper surface of the cartridge vessel 12, and a plane 19*b* continuous to the other side surface of the other end of the inclined surface 19*a* and substantially in parallel to the upper surface thereof. As the result of the fact that the engagement step portion 19 is provided, the ink cartridge 11 is formed so that height of the side surface where the plane 19*b* is provided is lower than the upper surface of the cartridge vessel 12 by one step, and is engaged with an engagement piece 23 of the cartridge body 21 at this step portion. As the result of the fact that the engagement step portion 19 is engaged with an engagement piece 23 of the loading portion 22 side of the head cartridge 2 provided at the side surface of the insertion end side when the ink cartridge 11 is inserted into the loading portion 22 of the head cartridge 2, the engagement step portion 19 serves as rotational fulcrum portion when the ink cartridge 11 is loaded into the loading portion 22.

The ink cartridge 11 of the configuration as stated above comprises, in addition to the above-described components, e.g., remaining quantity detecting portion (unit) for detecting the remaining quantity of ink 4 within the ink accommodating portion 13, and a discrimination portion (unit) for discriminating between ink cartridges 11*y*, 11*m*, 11*c*, 11*k*, etc.

Then, the head cartridge 2 to which ink cartridges 11*y*, 11*m*, 11*c*, 11*k* within which inks 4 of yellow, magenta, cyan and black are accommodated are loaded, which has been constituted as described above, will be explained.

As shown in FIGS. 2 and 3, the head cartridge 2 is composed of the above-described ink cartridge 11 and cartridge body 21. The cartridge body 21 includes loading portions 22*y*, 22*m*, 22*c*, 22*k* (hereinafter simply referred to as loading portion when the entirety thereof is indicated) to which ink cartridge 11 is loaded, an engagement piece 23 and a latch lever 24 which are adapted for fixing the ink cartridge 11, a biasing member 25 for biasing the ink cartridge 11 in a taking-out direction, a connecting portion 26 connected to the ink supply portion 14 and supplied with ink 4, an ink discharge head 27 for discharging inks 4, and a head cap 28 for protecting the ink discharge head 27.

The upper surface of the loading portion 22 to which the ink cartridge 11 is to be loaded is formed in a manner to take substantially recessed shape as insertion/withdrawal opening of the ink cartridge 11 so that the ink cartridge 11 is loaded thereto. In this example, four ink cartridges 11 are accommodated in line in a direction substantially perpendicular to width direction of the recording paper P, i.e., in carrying direction of the recording paper P. As the result of the fact that the ink cartridge 11 is accommodated at the loading portion 22, the loading portion 22 is provided in the state elongated in a direction of print width similarly to the ink cartridge 11. The ink cartridge 11 is accommodated and loaded at the cartridge body 21.

As shown in FIG. 2, the loading portion 22 is a portion to which ink cartridge 11 is loaded. The portion where ink cartridge 11*y* for yellow is loaded is caused to be a loading portion 22*y*, the portion where ink cartridge 11*m* for magenta is loaded is caused to be a loading portion 22*m*, the portion where ink cartridge 11*c* for cyan is loaded is caused to be a loading portion 22*c*, and the portion where ink cartridge 11*k* for black is loaded is caused to be loading portion 22*k*. The loading portions 22*y*, 22*m*, 22*c*, 22*k* are respectively partitioned by partition walls 22*a*. In this example, because use quantity of ink is generally many, the ink cartridge 11*c* for black is formed to be thick as described above so that the internal capacity becomes large. Therefore, width of the ink cartridge 11*k* is greater than those of other ink cartridges 11*y*, 11*m*, 11*c*. For this reason, the loading portion 22*k* is broader than other loading portions 22*y*, 22*m*, 22*c* in correspondence with thickness of the ink cartridge 11*k*.

Moreover, at the opening end of the loading portion 22 where the ink cartridge 11 is loaded, as shown in FIG. 3, there is provided an engagement piece 23. The engagement piece 23 is provided at one end edge in a length direction of the loading portion 22, and is engaged with engagement step portion 19 of the ink cartridge 11. The ink cartridge 11 is obliquely inserted into the loading portion 22 with the engagement step portion 19 side of the ink cartridge 11 being as insertion end, and can be loaded into the loading portion 22 in such a manner to rotate the side where the engagement step portion 19 is not provided of the ink cartridge 11 toward the loading portion 22 side with engagement position between engagement step portion 19 and engagement piece 23 being as fulcrum of rotation. Thus, the ink cartridge 11 can be easily loaded at the loading portion 22.

The latch lever 24 is formed by bending leaf spring, and is provided at the side surface opposite to the engagement piece 23 of the loading portion 22, i.e., at the side surface of the other end in length direction. The latch lever 24 is adapted so that the base end portion thereof is integrally provided at the bottom surface side of the side surface of the other end in length direction constituting the loading portion 22, the front end side thereof is formed so that elastic displacement is performed in a direction close to the side surface or away therefrom, and an engagement hole 24*a* is formed at the front end side thereof. At the same time when the ink cartridge 11 is loaded into the loading portion 22, the latch lever 24 is caused to undergo elastic displacement so that the engagement hole 24*a* is engaged with the holding projection 18 of the ink cartridge 11 to prevent the ink cartridge 11 loaded at the loading portion 22 from slipping off from the loading portion 22.

A biasing member 25 is provided by bending leaf spring which biases the ink cartridge 11 in a detachment direction thereof on the bottom surface of the side surface side corresponding to the engagement step portion 19 of the ink cartridge 11. The biasing member 25 is an eject member which has a summit portion formed by bending, and is caused to undergo elastic displacement in a direction close to the bottom surface or away therefrom to press the bottom surface of the cartridge 11 by the summit portion to bias the ink cartridge 11 loaded at the loading portion 22 in a taking-out direction from the loading portion 22. When engagement state between the engagement hole 24*a* and the holding projecting portion 18 of the latch lever 24 is released, the biasing member 25 ejects the ink cartridge 11 from the loading portion 23.

At substantially center in a length direction of respective loading portions 22*y*, 22*m*, 22*c*, 22*k*, there are provided connecting portions 26 to which ink supply portions 14 of the ink cartridges 11*y*, 11*m*, 11*c*, 11*k* are connected when ink cartridges 11*y*, 11*m*, 11*c*, 11*k* are loaded into the loading portions 22*y*, 22*m*, 22*c*, 22*k*. The connecting portion 26 serves as an ink supply path for supplying ink 4 from the ink supply portion 14 to the ink discharge head 27.

Figure 5:
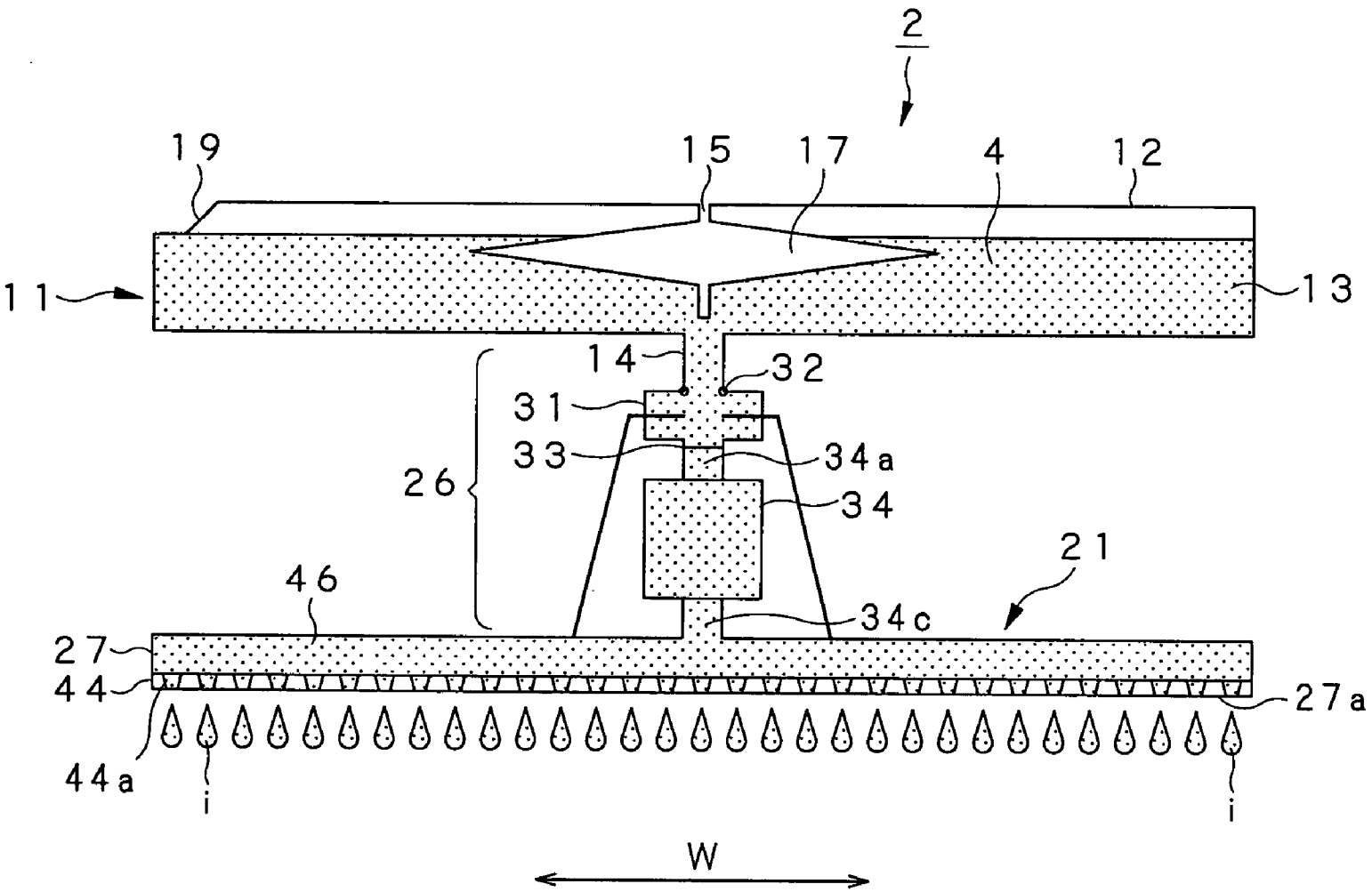
FIG. 5 is a cross sectional view showing the relationship between ink cartridge and ink discharge head which constitute the ink jet print head cartridge.

In concrete terms, as shown in FIG. 5, the connecting portion 26 includes an ink storage portion 31 for storing ink 4 supplied from the ink cartridge 11, a sealing member 32 for sealing the ink supply portion 14 connected to the connecting portion 26, a filter 33 for removing impurities within the ink 4, and a valve mechanism 34 for opening/closing the supply path toward the ink discharge head 27.

The ink storage portion 31 is a space portion connected to the ink supply portion 14 and adapted for storing ink 4 delivered from the ink cartridge 11. The sealing member 32 is a member provided at the upper end of the ink storage portion 31, and serves to seal the portion between ink storage portion 31 and ink supply portion 14 so that ink 4 is not leaked toward the outside when the ink supply portion 14 of the ink cartridge 11 is connected to the ink storage portion 31 of the connecting portion 26. A filter 33 serves to remove rubbishes such as dust, etc. which has been mixed into the ink 4 at the time of loading/unloading of the ink cartridges 11, etc., and is provided downwardly relative to the ink storage portion 31.

Figure 6A:
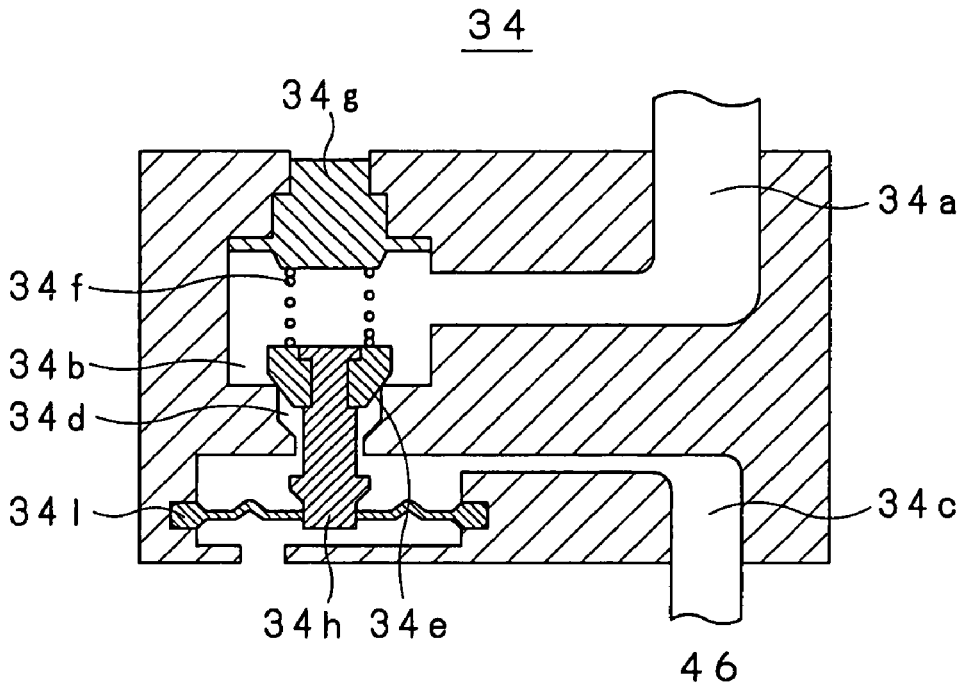
Figure 6B:
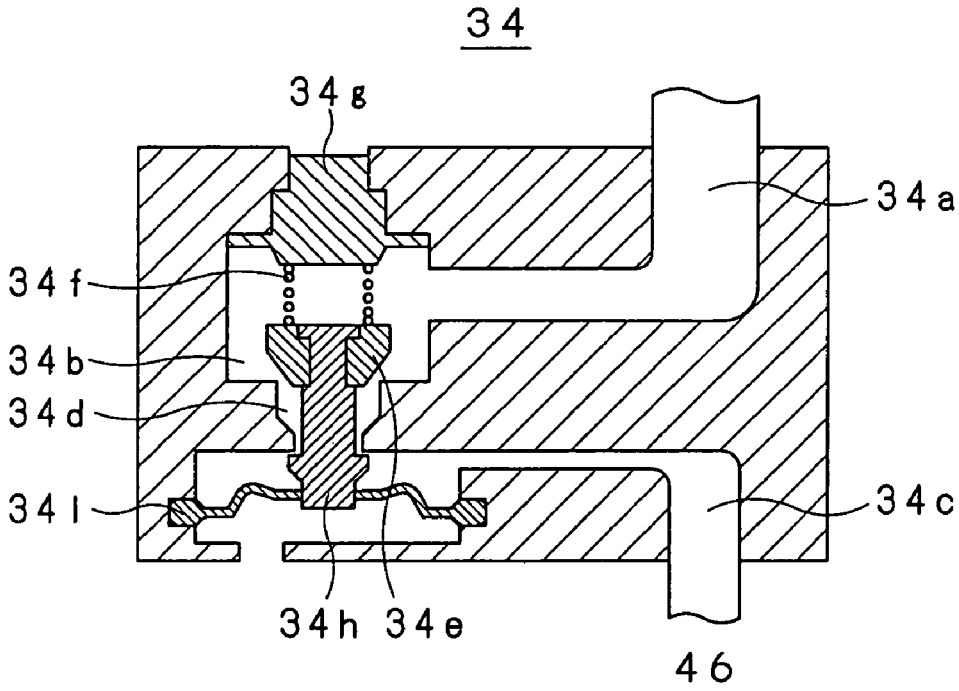

The valve mechanism 34 includes, as shown in FIGS. 6A and 6B, an ink flow-in path 34*a* supplied with ink 4 from the ink storage portion 31, an ink chamber 34*b* to which ink 4 is caused to flow in from the ink flow-in path 34*a*, an ink flow-out path 34*c* from which ink 4 is caused to flow out from the ink chamber 34*b*, an opening portion 34*d* provided between the ink flow-in path 34*a* side and the ink flow-out path 34*c* side of the ink chamber 34*b*, a valve 34*e* for opening/closing the opening portion 34*d*, a biasing member 34*f* for biasing the valve 34*e* in a direction to close the opening portion 34*d*, a negative pressure adjustment screw 34*g* for adjusting strength of the biasing member 34*f*, a valve shaft 34*h* connected to the valve 34*e*, and a diaphragm 34*i* connected to the valve shaft 34*h*.

The ink flow-in path 34*a* is a supply path connected to the ink accommodating portion 13 so as to have ability to deliver ink 4 within the ink accommodating portion 13 of the ink cartridge 11 through the ink storage portion 31 to the ink discharge head 27. The ink flow-in path 34*a* is provided within the range from the bottom surface side of the ink storage portion 31 to the ink chamber 34*b*. The ink chamber 34*b* is a space portion so as to take substantially rectangular parallelepiped shape, which is formed integrally with the ink flow-in path 34*a*, the ink flow-out path 34*c* and the opening portion 34*d*, and is adapted so that ink 4 is caused to flow in from the ink flow-in path 34*a* to allow ink 4 to flow out from the ink flow-out path 34*c* through the opening portion 34*d*. The ink flow-out path 34*c* is a supply path supplied with ink 4 through the opening portion 34*d* from the ink chamber 34*b*, and is further connected to the ink discharge head 27. The ink flow-out path 34*c* is extended from the bottom surface side of the ink chamber 34*b* up to the ink discharge head 27.

The valve 34*e* is a valve for closing the opening portion 34*d* to divide it into the ink flow-in path 34*a* side and the ink flow-out path 34*c* side, and is disposed within the ink chamber 34*b*. The valve 34*e* moves upwardly and downwardly by biasing force of a biasing member 34*f*, a restoring force of a diaphragm 34*i* connected through a valve shaft 34*h*, and negative pressure of ink 4 of the ink flow-out path 34*c* side. When the valve 34*e* is located at the position of the lower end, it closes the opening portion 34*d* in such a manner to separate the ink chamber 34*b* into the ink flow-in path 34*a* side and the ink flow-out path 34*c* side to interrupt supply of ink 4 to the ink flow-out path 34*c*. When the valve 34*e* is located at the upper end against biasing force of the biasing member 34*f*, the valve 34*e* permits supply of ink 4 to the ink discharge head 27 without interrupting (separating) the ink chamber 34*b* into the ink flow-in path 34*a* side and the ink flow-out 34*c* side. It is to be noted that although kind of material constituting the valve 34*e* is not limited, the valve 34*e* may be formed by, e.g., rubber elastic body so-called elastomer, etc. in order to ensure high closing property.

The biasing member 34*f* is, e.g., compression coil spring, etc. and serves to connect negative pressure adjustment screw 34*g* and valve 34*e* between the upper surface of the valve 34*e* and the upper surface of the ink chamber 34*b* to bias the valve 34*e* by biasing force in a direction to close the opening portion 34*d*. The negative pressure adjustment screw 34*g* is a screw for adjusting biasing force of the biasing member 34*f*, and serves to adjust the negative pressure adjustment screw 34*g* to thereby have ability to adjust biasing force of the biasing member 34*f*. Thus, although the detail will be described later, the negative pressure adjustment screw 34*g* can adjust negative pressure of ink 4 which operates valve 34*e* for opening/closing the opening portion 34*d* although the detail thereof will be described later.

A valve shaft 34*h* is a shaft provided in order to connect the valve 34*e* connected to one end thereof and diaphragm 34*i* connected to the other end thereof to perform motion. The diaphragm 34*i* is a thin elastic plate connected to the other end of the valve shaft 34*h*. The diaphragm 34*i* consists of one principal surface of the ink flow-out path 34*c* side of the ink chamber 34*b* and the other principal surface in contact with air, and is caused to undergo elastic displacement toward the air side and the ink flow-out path 34*c* side by air pressure and negative pressure of ink 4.

In the valve mechanism 34 as stated above, as shown in FIG. 6A, the valve 34*e* is pressed by biasing force of the biasing member 34*f* and biasing force of the diaphragm 34*i* so as to close the opening portion 34*d* of the ink chamber 34*b*. Further, in the case where ink 4 is discharged from the ink discharge head 27, when negative pressure of the ink 4 of the ink chamber 34*b* of the ink flow-out path 34*c* side divided at the opening portion 34*d* is increased, the diaphragm 34*i* is pushed upwardly by negative pressure of the ink 4 and air as shown in FIG. 6B to push upwardly the valve 34*e* against biasing force of the biasing member 34*f* along with the valve shaft 34*h*. At this time, the opening portion 34*d* between the ink flow-in path 34*a* side and the ink flow-out path 34*c* side of the ink chamber 34*b* is opened. Thus, ink 4 is delivered from the ink flow-in path 34*a* side toward the ink flow-out path 34*c* side. Further, negative pressure of the ink 4 is lowered. As a result, the diaphragm 34*i* is restored to original form by restoring force to pull downwardly valve 34*e* along with valve shaft 34*h* by biasing force of the biasing member 34*f* so that the ink chamber 34*b* is closed. In a manner as stated above, at the valve mechanism 34, when negative pressure is increased every time ink 4 is discharged, the above-described operation is repeated.

At the connecting portion 26, when ink 4 within the ink accommodating chamber 13 is delivered to the ink chamber 34*b*, ink 4 within the ink accommodating portion 13 is decreased. However, at this time, air is admitted from the air introduction path 16 into the ink cartridge 11. The air which has been admitted into the ink cartridge 11 is sent toward the upper portion of the ink cartridge 11. Thus, the state returns to the state where ink droplet i is discharged from nozzle 44*a* which will be described later so that there results equilibrium state. At this time, there results equilibrium state as the state where ink 4 hardly exists within the air introduction path 16.

As shown in FIG. 5, the ink discharge head 27 is disposed along the bottom surface of the cartridge body 21, and is adapted so that nozzles 44*a*, which will be described later, serving as an ink discharge hole for discharging ink droplet i delivered from the connecting portion 26 are caused to take substantially line shape in width direction of the recording paper P, i.e., in a direction indicated by arrow W in FIG. 5 every respective colors.

As shown in FIG. 2, the head cap 28 is a cover provided for the purpose of protecting the ink discharge head 27, and is detached from the ink discharge head 27 when print operation is performed. The head cap 28 includes a groove portion 28*a* provided in opening/closing direction, and a cleaning roller 28*b* provided in a length direction and for absorbing excess ink 4 attached to the discharge surface 27*a* of the ink discharge head 27. At the time of opening/closing operation, the head cap 28 is adapted to be opened or closed in short direction of the ink cartridge 11 along the groove portion 28*a*. At this time, as the result of the fact that the cleaning roller 28*b* rotates while being in contact with the discharge surface 27*a* of the ink discharge head 27, it absorbs excess ink 4 to clean the discharge surface 27*a* of the ink discharge head 27. As the cleaning roller 28*b*, e.g., member having high water absorption property is used. In addition, when print operation is not performed, the head cap 28 serves to prevent ink 4 within the ink discharge head 27 from being dried.

The head cartridge 2 having a configuration as described above comprises, in addition to the above-described components, e.g., a remaining quantity detecting portion (unit) for detecting ink remaining quantity within ink cartridge 11, and an ink presence/absence detecting portion (unit) for detecting presence or absence of ink 4 when the ink supply unit 14 is connected to the connecting unit 26.

Figure 7:
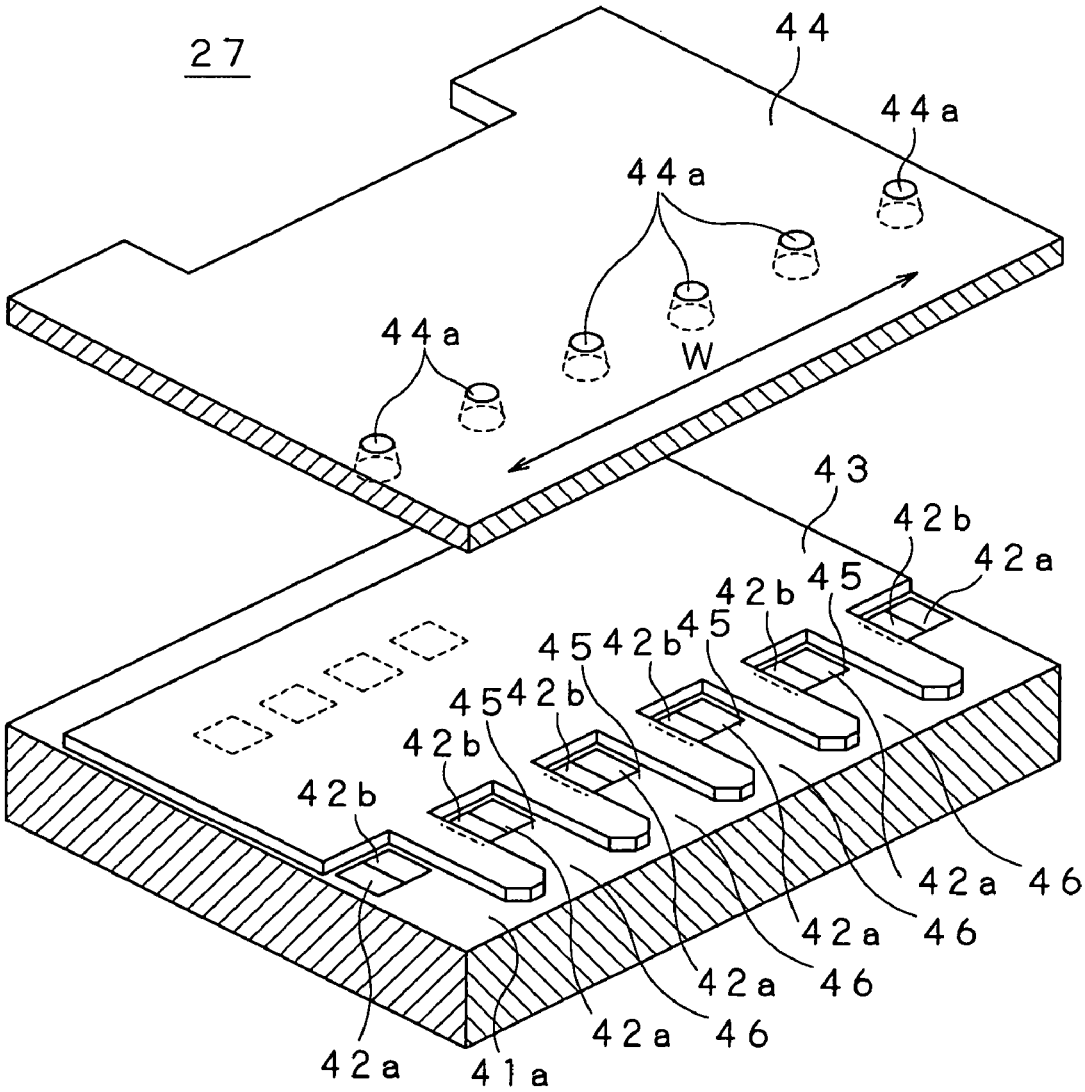
FIG. 7 is an exploded perspective view showing ink discharge head of the ink jet print head cartridge.
Figure 8:
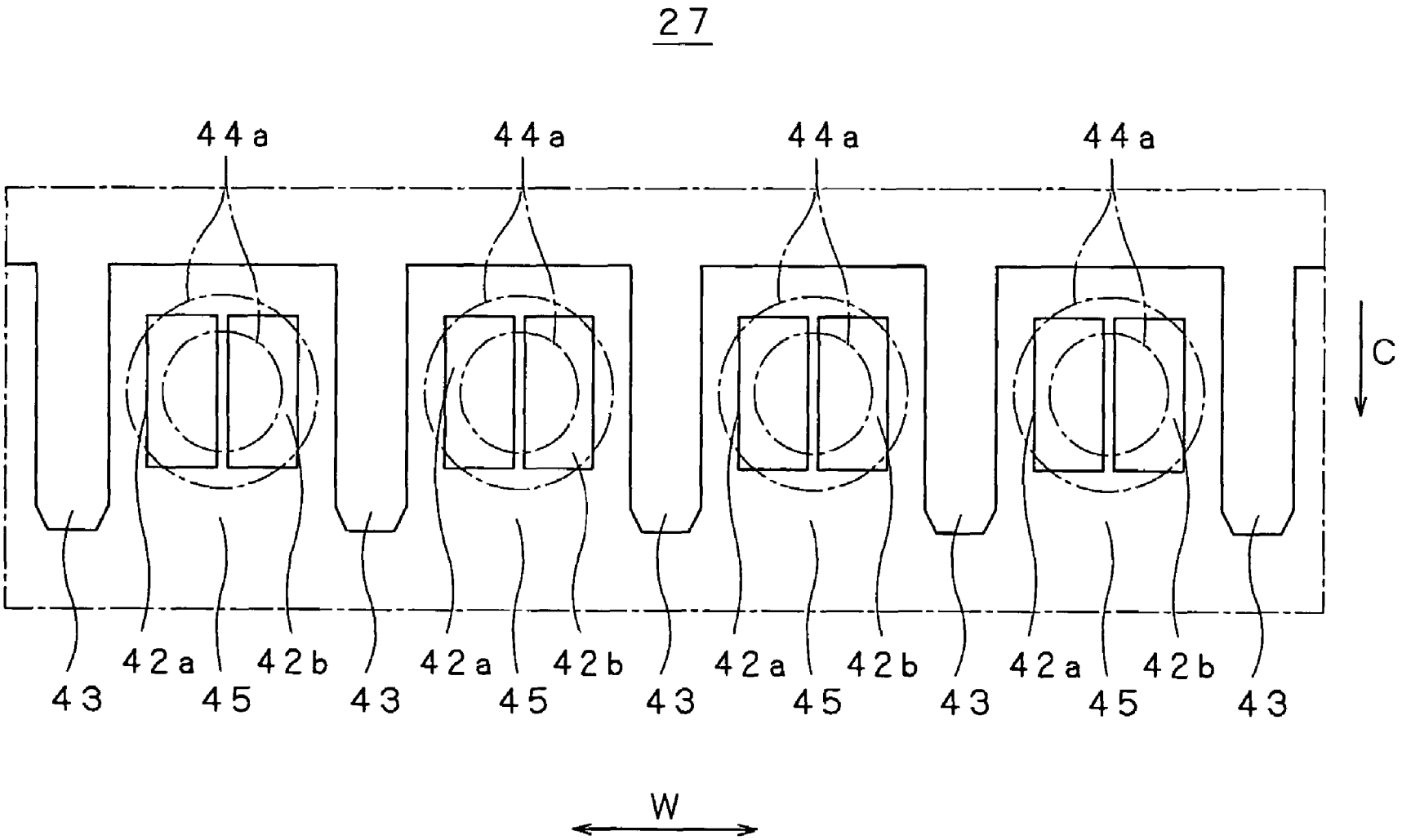
FIG. 8 is a plan view showing ink discharge head.

As shown in FIGS. 7 and 8, in correspondence with inks 4 of respective colors, the above-described ink discharge head 27 includes a substrate 41 serving as base, pairs of heating resistors 42*a*, 42*b* provided in parallel in a direction substantially perpendicular to carrying direction of the recording paper P, i.e., in width direction of the recording paper P, a film 43 for preventing leakage of ink 4, a nozzle sheet 44 provided with a large number of nozzles 44*a* from which inks 4 are discharged in the state of droplet, an ink liquid chamber 45 surrounding by these components and serving as a space supplied with ink 4, and an ink flow path 46 for supplying inks 4 to the ink liquid chamber 45.

The substrate 41 is a semiconductor substrate of silicon, etc. and is adapted so that pairs of heating resistors 42*a*, 42*b* are formed on one principal surface 41 a thereof and the respective pairs of heating resistors 42*a*, 42*b* are connected to discharge control unit which will be described later on the substrate 41. The discharge control unit 63 is an electric circuit constituted by logic ICs (Integrated Circuits) and/or driver transistors, etc.

The pair of heating resistors 42*a*, 42*b* are pressure generating elements which are heated by pulse current delivered from the discharge control unit 63 to heat inks 4 within the ink liquid chamber 45 to increase internal pressure. Further, inks 4 heated by the pair of heating resistors 42*a*, 42*b* are discharged in the state of droplet from nozzles 44*a* provided at nozzle sheet 44 which will be described later.

The film 43 is laminated on one principal surface 41 a of the substrate 41. The film 43 consists of, e.g., dry film resist of the exposure hardening type. The film 43 is laminated substantially over one principal surface 41*a* of the substrate 41. Thereafter, unnecessary portions are removed by photolithographic process. Thus, the film 43 is formed in a manner to surround the pair of heating resistors 42*a*, 42*b* in substantially recessed form. At the film 43, portions which surround respective pairs of heating resistors 42*a*, 42*b* form a portion of the ink liquid chamber 45.

The nozzle sheet 44 is a sheet shaped member having thickness of about 10 μm to 15 μm where nozzles 44*a* for discharging ink droplet i are formed, and is laminated on the surface opposite to the circuit substrate 41 of the film 43. The nozzles 44*a* are very small holes having diameter of about 15 μ to 18 μm opened in circular shape at the nozzle sheet 44, and are disposed in a manner opposite to the pairs of heating resistors 42*a*, 42*b*. In this example, the nozzle sheet 44 constitutes a portion of the ink liquid chamber 45.

The ink liquid chamber 45 is a space portion surrounded by the substrate 41, the pairs of heating resistors 42*a*, 42*b*, the film 43 and the nozzle sheet 44, and is a space adapted for storing ink 4 delivered from the ink flow path 46. The ink 4 within ink liquid chamber 45 is heated by the pairs of heating resistors 42*a*, 42*b* so that internal pressure is raised.

The ink flow path 46 is connected to the ink flow-out path 34*c* of the connecting portion 26. Thus, ink 4 is delivered from the ink cartridge 11 connected to the connecting portion 26 to form flow path for sending out ink 4 to respective ink liquid chambers 45 communicating with the ink flow path 46.

Namely, the ink flow path 46 and the connecting portion 26 are caused to communicate with each other. Thus, inks 4 delivered from the ink cartridge 11 flow into the ink flow path 46 and are filled into the ink liquid chamber 45.

At the above-described one ink discharge head 27, pairs of heating resistors 42*a*, 42*b* are provided every ink liquid chamber 45. There are provided about 100 to 5000 ink liquid chambers 45 in which such pair of heating resistors 42*a*, 42*b* are provided every respective color ink cartridges 11. Further, at the ink discharge head 27, by instruction from the control unit 68 of the printer apparatus 1, these pairs of heating resistors 42*a*, 42*b* are suitably selected and are heated. The ink 4 within the ink liquid chamber 45 corresponding to heated pair of heating resistors 42*a*, 42*b* is caused to be discharged in the state of droplet from corresponding nozzle 44*a* to the ink liquid chamber 45.

Namely, at the ink discharge head 27, ink 4 delivered from ink flow path 46 connected to the ink discharge head 27 is filled within the ink liquid chamber 45. Further, pulse current is caused to flow for short time, e.g., 1 to 3 μsec. at the pair of heating resistors 42*a*, 42*b*. Thus, the pair of heating resistors 42*a*, 42*b* are respectively and rapidly heated. As a result, ink 4 of the portion in contact with the pair of heating resistors 42*a*, 42*b* is headed. Thus, ink bubbles of vapor phase are produced. Ink 4 of a certain volume is pressed by expansion (swelling) of the ink bubbles (ink 4 is boiled). Thus, ink 4 having capacity equivalent to the ink 4 which has been pressed onto ink bubbles at the portion in contact with the nozzle 44*a* is discharged from nozzles 44*a* as ink droplet i. As a result, the ink 4 is hit upon the recording paper P.

At the ink discharge head 27, as shown in FIG. 8, a pair of heating resistors 42*a*, 42*b* are provided substantially in parallel to each other within one ink liquid chamber 45. Namely, a pair of heating resistors 42*a*, 42*b* are provided within one ink liquid chamber 45. Further, at the ink discharge head 27, there are arranged plural sets of heating resistors 42*a*, 42*b* provided substantially in parallel to each other in a direction substantially perpendicular to carrying direction of the recording paper P indicated by arrow C in FIG. 11, i.e., in width direction of the recording paper P indicated by arrow W in FIG. 11. In this example, in FIG. 11, positions of the nozzles 44*a* are indicated by single dotted lines.

As stated above, since the pair of heating resistors 42*a*, 42*b* take such shape to divide one resistor into two resistor portions so that the lengthy is the same and the width is halved, resistance values of respective resistors substantially become double value. In the case where resistors at these pairs of heating resistors 42*a*, 42*b* are connected in series, there results the state where resistors having resistance values of about double value are connected in series. Thus, resistance value thereof is four times greater than that of the resistor value before division.

Here, in order to boil ink 4 within the ink liquid chamber 45, it is necessary to apply a predetermined pulse current to the pair of heating resistors 42*a*, 42*b* to heat the pair of heating resistors 42*a*, 42*b*. By energy at the time of boiling, ink droplet i is discharged. Further, when resistance value is small, it is necessary to increase pulse current caused to flow. However, since the pair of heating resistors 42*a*, 42*b* caused to have a shape such that one resistor is divided into two resistor elements has high resistance value, it becomes possible to make boiling by pulse current of small value.

Thus, at the ink discharge head 27, transistor for allowing pulse current to flow, etc. can be reduced. As a result, reduction in space can be realized. It is to be noted that if a pair of heating resistors 42*a*, 42*b* are formed so that thickness becomes small, resistance value can be further increased, but there is a predetermined limit for reducing the thickness of the pair of heating resistors 42*a*, 42*b* from the viewpoint of material selected as a pair of heating resistors 42*a*, 42*b* and/or strength (durability) thereof, etc. For this reason, division is made without reducing the thickness to thereby increase resistance values of the pair of heating resistors 42*a*, 42*b*.

Meanwhile, in discharging inks within the ink liquid chamber 45 from nozzles 44*a*, when drive control of a pair of heating resistors 42*a*, 42*b* is performed so that time periods until ink within the ink liquid chamber 45 is boiled by a pair of heating resistors 42*a*, 42*b*, i.e., bubble generation time periods are the same, ink droplet i is discharged from nozzles 44*a* toward the portion substantially immediately below. In addition, in the case where time difference takes place in bubble generation time of the pair of heating resistors 42*a*, 42*b*, it becomes difficult to produce ink bubbles substantially at the same time on the pair of heating resistors 42*a*, 42*b*. As a result, ink droplet i is discharged in the state shifted to any one of directions where a pair of heating resistors 42*a*, 42*b* are arranged.

Figure 9:
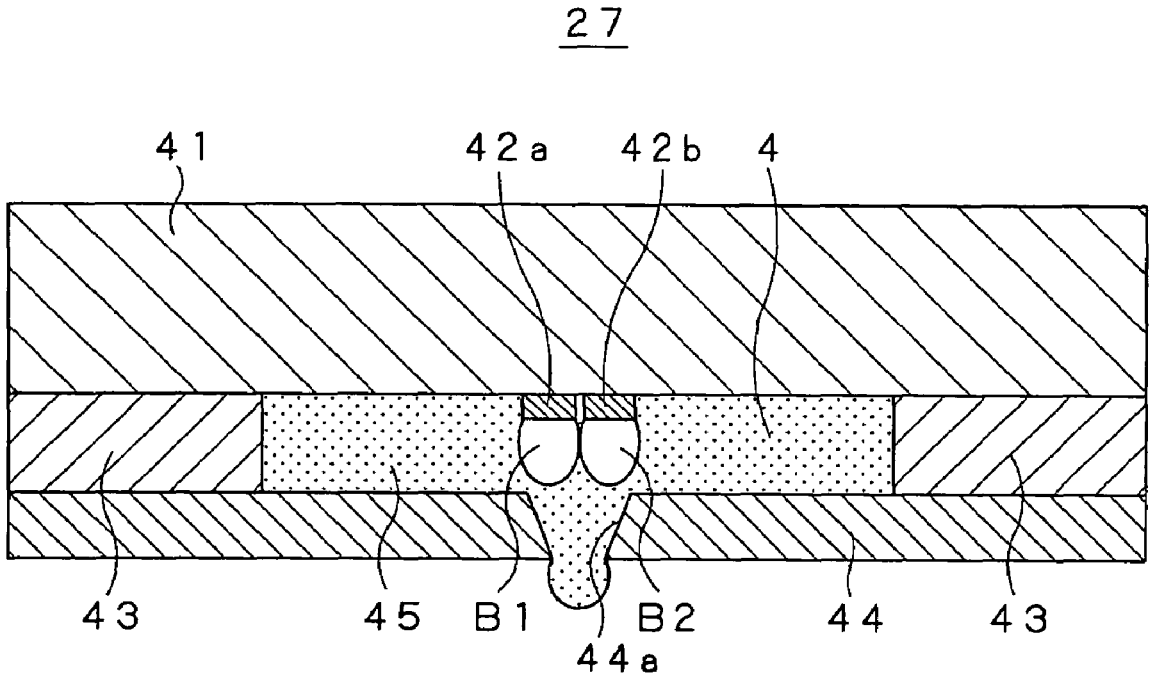
FIG. 9 shows the state where the ink discharge head discharges ink droplet, and is a cross sectional view showing the state where ink bubbles having substantially the same size are formed within ink liquid chamber.
Figure 10:
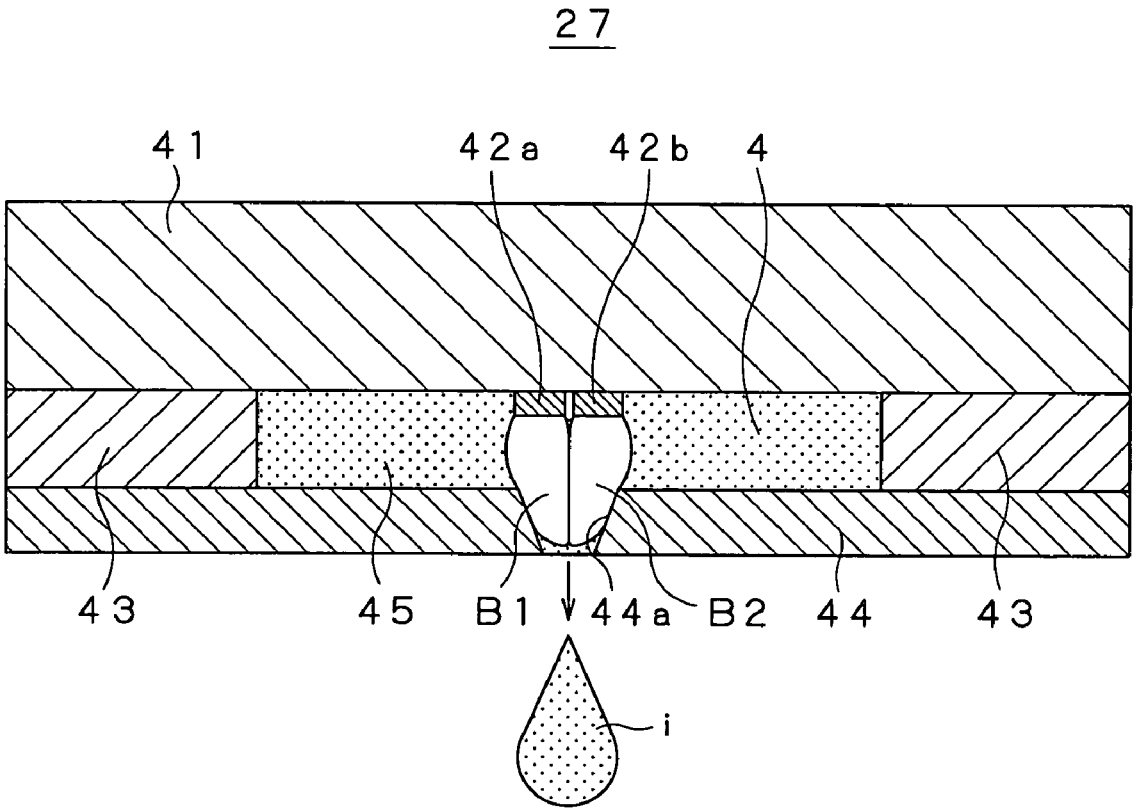
FIG. 10 explains the state where the ink discharge head discharges ink droplet, and is a cross sectional view showing the state where ink droplet is discharged toward the portion substantially immediately below from nozzles by two ink bubbles.

In concrete terms, as shown in FIG. 9, ink 4 is supplied by the ink flow path 46 connected to the ink discharge head 27 so that ink 4 is filled within the ink liquid chamber 45. Further, as the result of the fact that pulse currents having the same current value are delivered to the pair of heating resistors 42*a*, 42*b* substantially at the same timing, the pair of heating resistors 42*a*, 42*b* are rapidly heated substantially at the same time. As a result, ink bubbles B 1, B2 having substantially the same volume are respectively produced at the ink 4 of the portion in contact with the pair of heating resistors 42*a*, 42*b* so that ink 4 having a predetermined volume is pressed by expansion (swelling) of the ink bubbles B1, B2. Thus, at the ink discharge head 27, as shown in FIG. 10, ink 4 having capacity equivalent to the ink 4 pressed substantially vertically toward the recording paper P by the ink bubbles B1, B2 at the portion in contact with the nozzle 44*a* is discharged toward the portion substantially directly below from the nozzle 44*a* as ink droplet i, and is hit upon the recording paper P.

Figure 11:
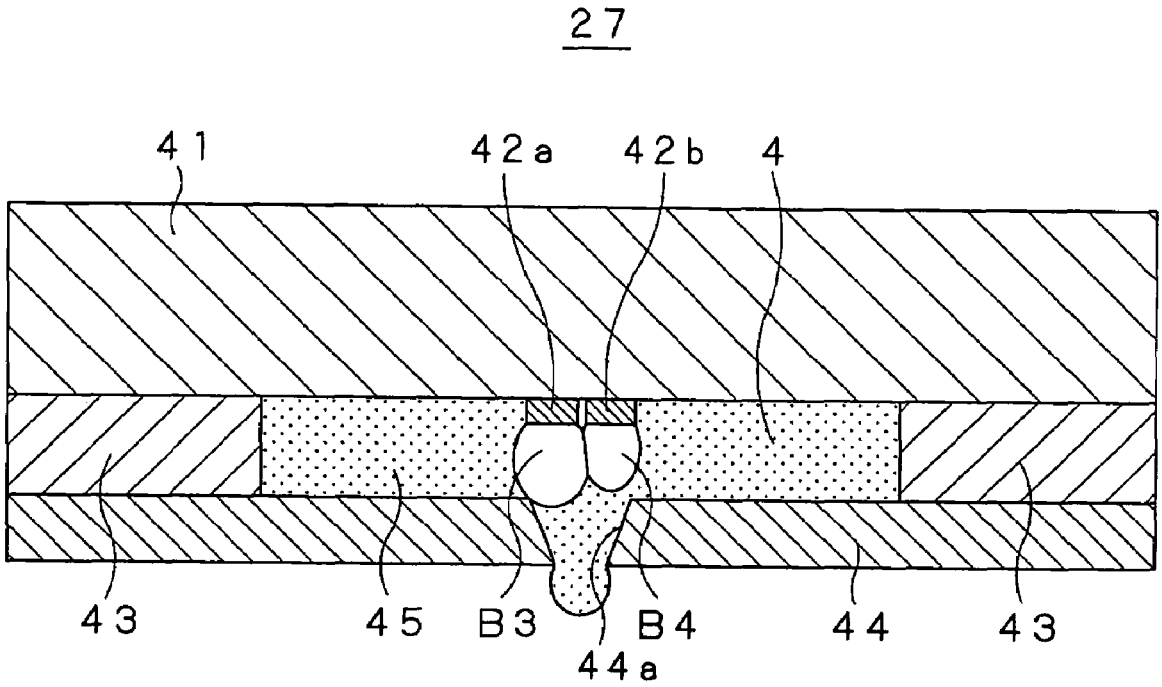
FIG. 11 shows the state where the ink discharge head discharges ink droplet, and is a cross sectional view showing the state where ink bubbles having different sizes are formed within ink liquid chamber.
Figure 12:
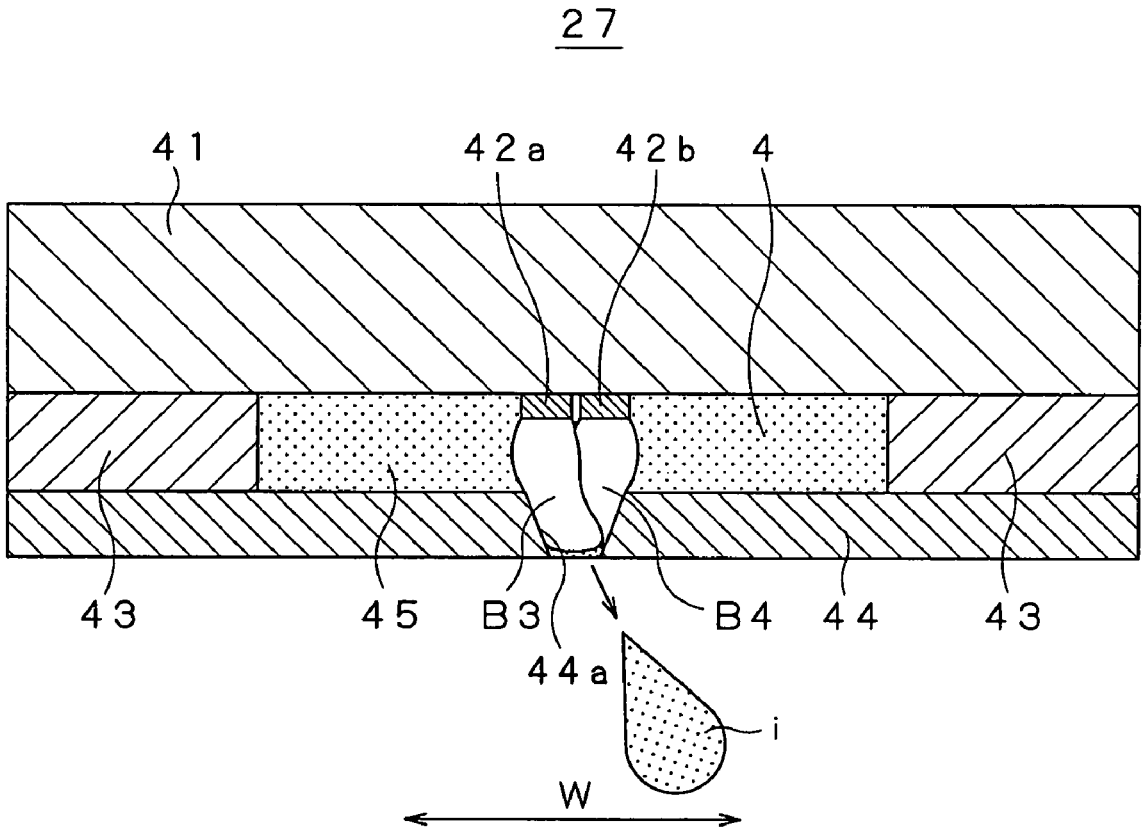
FIG. 12 shows the state where the ink discharge head discharges ink droplet, and is a cross sectional view showing the state where ink droplet is discharged in substantially oblique direction from nozzles by two ink bubbles.

Moreover, at the ink discharge head 27, as shown in FIG. 11, when pulse currents are delivered to the pair of heating resistors 42*a*, 42*b* at different timings, ink bubbles B3, B4 are respectively produced at different timings at ink 4 of the portion in contact with the pair of heating resistors 42*a*, 42*b*. From this fact, by expansion (swelling) process by different timings of these ink bubbles B3, B4, ink 4 having a predetermined volume is pressed. Thus, at the ink discharge head 27, as shown in FIG. 12, ink droplet i is discharged in the state shifted toward ink bubbles having late bubble generation timing of ink bubbles B3, B4 in width direction of the recording paper P indicated by arrow W in FIG. 15 from the nozzle 44*a*, and is hit onto the recording paper P.

In view of the above, in the present invention, in the case where supply timings of pulse currents delivered to pair of heating resistors 42*a*, 42*b*, reference pulse current is delivered to either one of heating resistors of the pair of heating resistors 42*a*, 42*b*, and pulse current having substantially the same current value as the reference pulse current is delivered to the other heating resistor in the state where the time of the range within 20% of supply time of the reference pulse current is shifted from the supply timing of the reference pulse current.

Thus, at the ink discharge head 27, expansion (swelling) process by different timings of ink bubbles B3, B4 formed on a pair of heating resistors 42*a*, 42*b* becomes stable. As a result, it is possible to suppress that discharge direction of ink droplet i is varied.

Moreover, at the ink discharge head 27, since different pulse currents are delivered to a pair of heating resistors 42*a*, 42*b* at suitable timings, it is possible to prevent inconvenience such that ink droplet i comes into contact with the edge of nozzle 44*a*. Thus, it is possible to suppress that discharge direction of the ink droplet i is varied.

The printer body 3 constituting the printer apparatus 1 to which the head cartridge 2 constituted as described above is loaded will now be explained with reference to the attached drawings.

Figure 13:
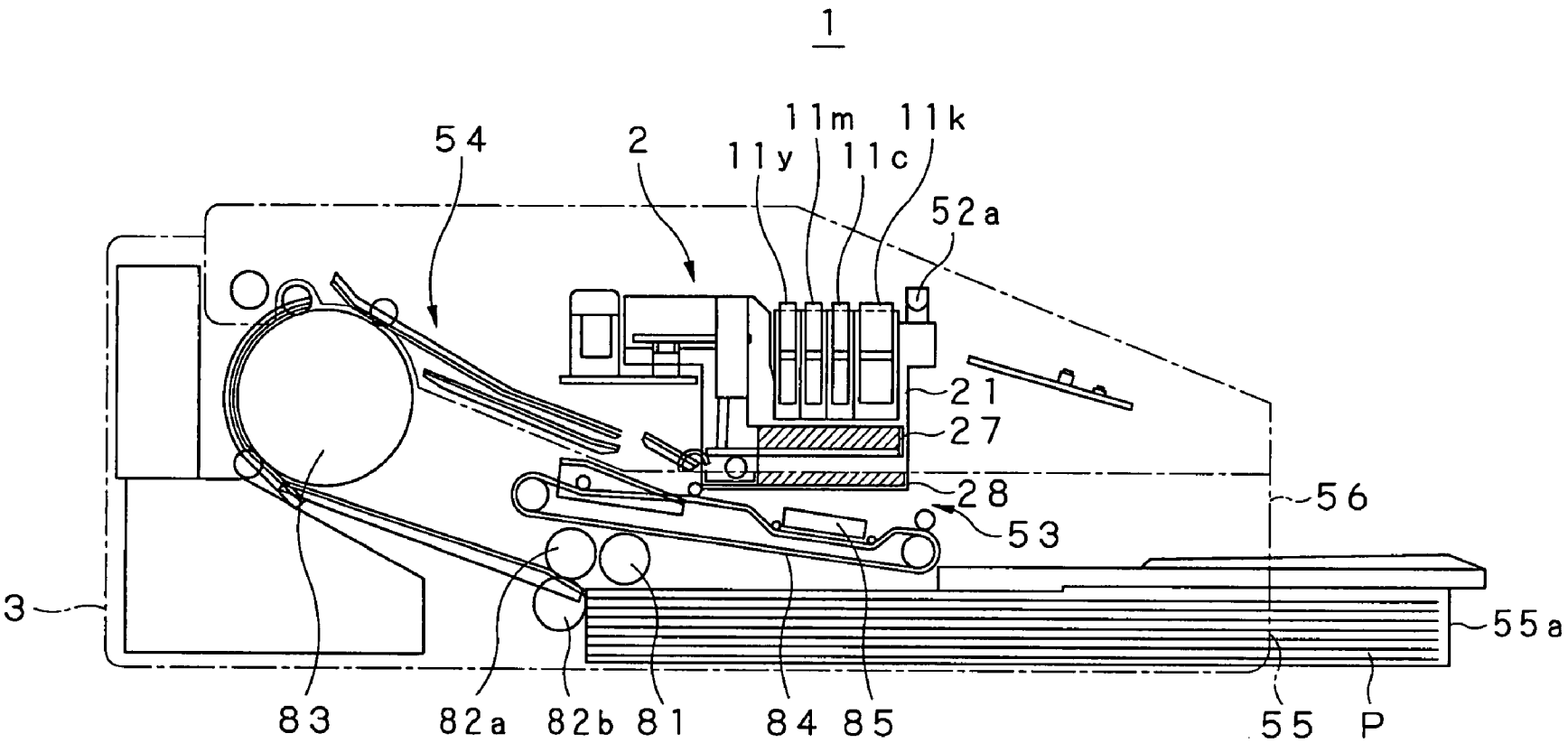
FIG. 13 is a side view perspectively showing a portion of the liquid discharge apparatus.

The printer body 3 includes, as shown in FIGS. 1 and 13, a head cartridge loading portion 51 to which the head cartridge 2 is loaded, a head cartridge holding mechanism 52 for holding/fixing the head cartridge 2 at the head cartridge loading portion 51, a head cap opening/closing mechanism 53 for opening/closing the head cap, a paper feed/eject mechanism 54 for performing paper feed/eject operation of the recording paper P, a paper feed opening 55 for feeding recording paper P to the paper feed mechanism 54, and a paper eject opening 56 in which recording paper P is ejected from the paper feed/eject mechanism 54.

The head cartridge loading portion 51 is a recessed portion where the head cartridge 2 is loaded, and is such that the head cartridge 2 is loaded so that the discharge surface 27*a* of the ink discharge head 27 and paper surface of the traveling recording paper P are substantially in parallel with each other in order to perform print operation in conformity with data onto traveling recording paper. The head cartridge 2 is consumable supplies because there is the case where necessity of exchange may take place owing to ink clogging within ink discharge head 27, etc. For this reason, the head cartridge 2 is held by the head cartridge holding mechanism 52 so that it is detachable with respect to the head cartridge loading portion 51.

The head cartridge holding mechanism 52 is a mechanism for detachably holding the head cartridge 2 at the head cartridge loading portion 51. By holding knob 52 provided at the head cartridge 2 with respect to biasing member such as spring, etc. (not shown) provided within holding hole 52*b* of the printer body 3, the head cartridge 2 can be held and fixed after undergone positioning in such a manner caused to be in pressure-contact with reference surface 3*a* provided at the printer body 3.

The head cap opening/closing mechanism 53 includes a drive unit for opening/closing head cap 28 of the head cartridge 2. When print operation is performed, the head cap opening/closing mechanism 53 opens the head cap 28 to allow the ink discharge head 27 to be exposed to the recording paper P. When print operation is completed, the head cap opening/closing mechanism 53 closes the head cap 28 to protect the ink discharge head 27.

A paper feed/eject mechanism 54 includes a drive portion for carrying the recording paper P, and serves to carry the recording paper P delivered from the paper feed opening 55 up to ink discharge head 27 of the head cartridge 2 so that ink droplet i discharged from the nozzle 44*a* is hit to carry the printed recording paper P to the paper eject hole 56 to eject it toward the external of the apparatus. The paper feed hole 55 is an opening portion for supplying the recording paper P to the paper feed/eject mechanism 54, and is adapted to have ability to stock plural recording papers P within the tray 55*a*, etc. in a stacked manner. The paper eject hole 56 is an opening portion in which ink droplet i is hit to eject printed recording paper P.

A control circuit 61 shown in FIG. 14 for controlling print operation by the printer apparatus 1 constituted as described above will now be explained with reference to the attached drawings.

The control circuit 61 includes a printer drive unit 62 for performing drive control of respective drive mechanisms 53, 54 of the above-described printer body 3, a discharge control unit 63 for controlling current, etc. delivered to ink discharge heads 27 corresponding to inks 4 of respective colors, a warning unit 64 for warning the remaining quantities of inks 4 of respective colors, an input/output terminal 65 for performing input/output operation of signal to and from the external equipment, a ROM (Read Only Memory) 66 in which control programs, etc. are recorded, a RAM (Random Access Memory) 67 for temporarily storing control programs, etc. which have been read out so that they are read out as occasion demands, and a control unit 68 for performing controls of respective units.

The printer drive unit 62 drives drive motor constituting the head cap opening/closing mechanism 53 on the basis of a control signal from the control unit 68 to control the head cap opening/closing mechanism in such a manner to open or close the head cap 28. Moreover, the printer drive unit 62 drives the drive motor constituting the paper feed/eject mechanism 54 on the basis of a control signal from the control unit 68 to feed the recording paper P from the paper feed hole of the printer body 3 to control the paper feed/eject mechanism in a manner to eject the recording paper P from the paper eject hole 56 after printing operation.

Figure 15:
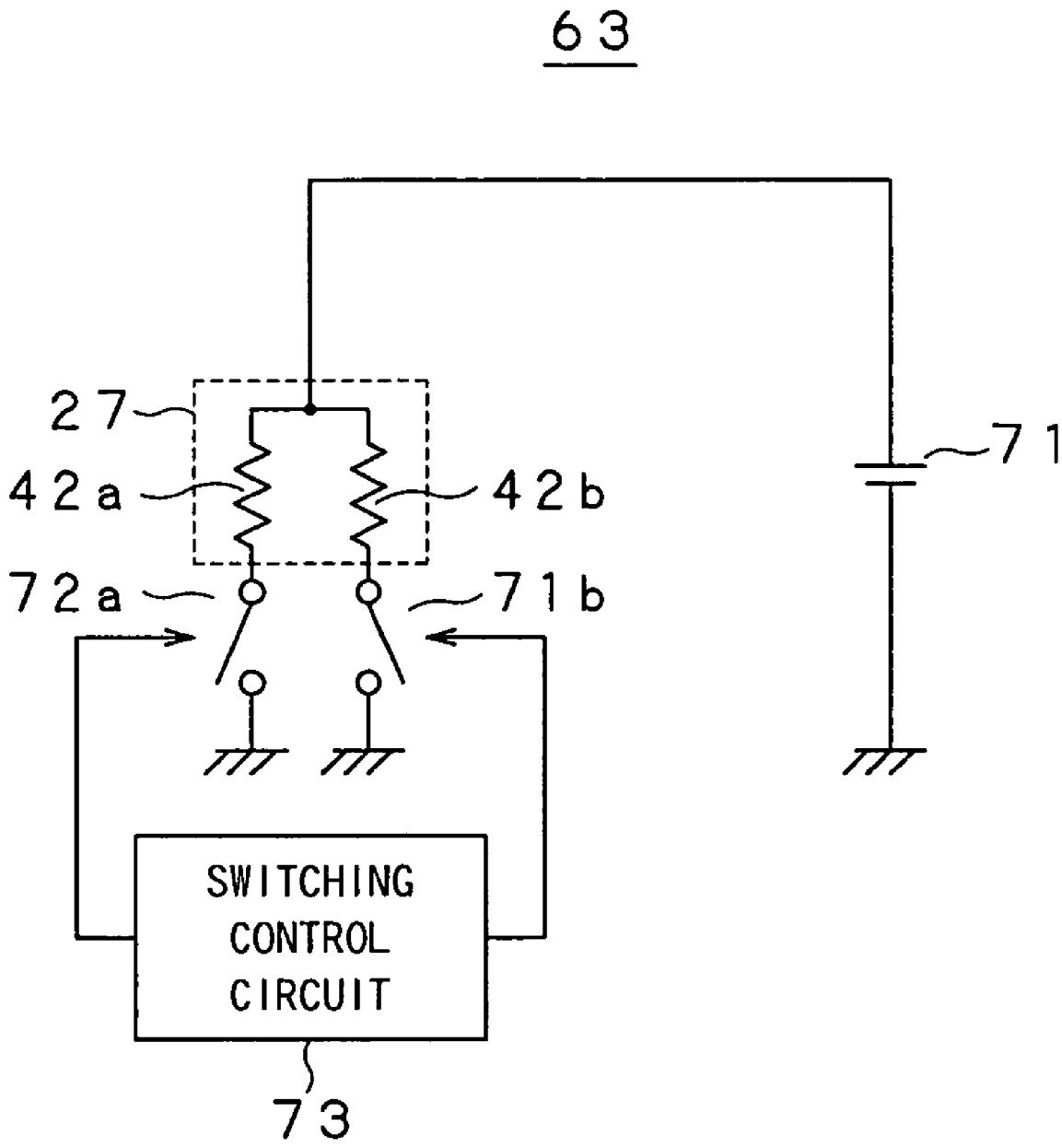
FIG. 15 is a circuit diagram showing discharge control unit of the control circuit.

As shown in FIG. 15, the discharge control unit 63 is an electric circuit comprising a power supply 71 for allowing pulse currents to flow at a pair of heating resistors 42*a*, 42*b* respectively serving as resistors, switching elements 72*a*, 72*b* for respectively performing ON/OFF operation of electric connection between the pair of heating resistors 42*a*, 42*b* and the power supply 71, and a switching control circuit 73 for controlling switching operations of the switching elements 72*a*, 72*b*.

The power supply 71 is connected to the heating resistors 42*a*, 42*b* and serves to allow pulse currents to flow at respective heating resistors. It is to be noted that while the power supply 71 may be used as power supply for pulse current delivered to the electric circuit, pulse current may be directly delivered from, e.g., control unit 68, etc.

The switching element 72*a* is disposed between the heating resistor 42*a* and the ground, and serves to control ON/OFF operation of pulse current flowing in the heating resistor 42*a*. The switching element 72*b* is disposed between the heating resistor 42*b* and the ground, and serves to control ON/OFF operation of pulse current flowing in the heating resistor 42*b*. Further, these switching elements 72*a*, 72*b* deliver pulse currents from the power supply 71 to the pair of heating resistors 42*a*, 42*b* substantially at the same timing or at different timings as the result of the fact that ON/OFF operations of respective switching elements are switched.

The switching control circuit 73 is an electric circuit composed of, e.g., logic ICs and/or driver transistors, etc., and serves to switch ON/OFF operations of the switching elements 72*a*, 72*b* to connect the power supply 71 and the pair of heating resistors 42*a*, 42*b* to brought these heating resistors into ON state, or to ground the pair of heating resistors 42*a*, 42*b* to brought these heating resistors into OFF state. Further, the switching control circuit 73 respectively switches ON/OFF operations of the switching elements 72*a*, 72*b* to thereby control timings at which pulse currents are respectively delivered to the pair of heating resistors 42*a*, 42*b*, or time periods during which pulse current is delivered, etc.

At the discharge control unit 63 having a configuration as stated above, when the switching control circuit 73 turns the switching elements 72*a*, 72*b* ON substantially at the same timing, pulse currents are both delivered to the pair of heating resistors 42*a*, 42*b* from the power supply 71 substantially at the same timing. At this time, in the case where resistance values of the pair of heating resistors 42*a*, 42*b* are substantially the same, a pair of heating resistors 42*a*, 42*b* are heated substantially at the same timing when pulse currents are delivered.

Figure 16A:
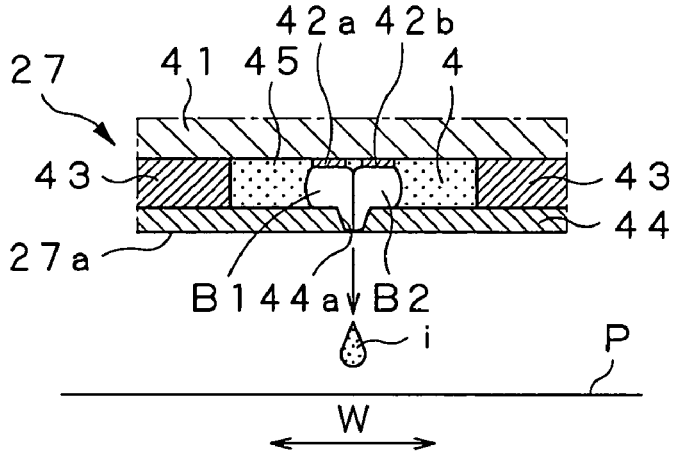

In this case, at the ink discharge head 27, as shown in FIG. 16A, since a pair of heating resistors 42*a*, 42*b* are heated substantially at the same timing, expansion (swelling) process of bubbles substantially become the same. As a result, ink bubbles B1, B2 having substantially the same size are formed substantially at the same timing on the pair of heating resistors 42*a*, 42*b*. Thus, ink droplets i are discharged toward the portion substantially below from nozzles 44*a*.

Then, explanation will be given in connection with the case where the discharge control unit 63 controls the switching control circuit 73 in such a manner to first turn the switching element 72*a* ON to subsequently turn the switching element 72*b* ON in a delayed manner.

Figure 16B:
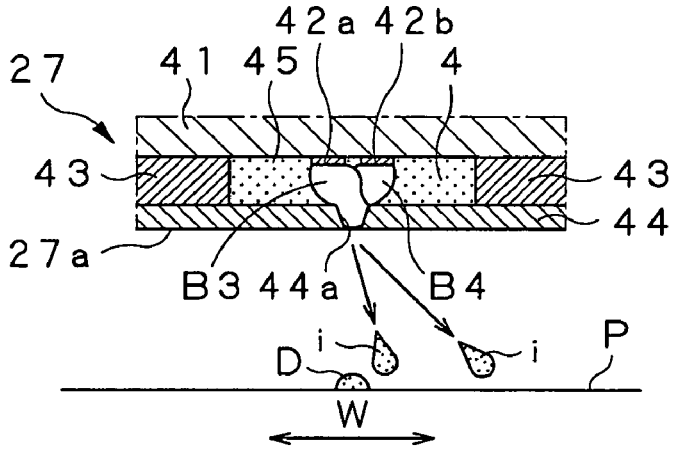

In this case, as shown in FIG. 16B, the discharge direction of ink droplet i can be varied (adjusted) toward the heating resistor 42 side of width direction W of the recording paper P. Namely, as the result of the fact that the switching element 72*a* is first placed in ON state, pulse current is delivered to the heating resistor 42*a* prior to the heating resistor 42*b*. As a result, bubbles are produced on the heating resistor 42*a* prior to production thereof on the heating resistor 42*b*. Further, expansion (swelling) process of ink bubbles B3 formed on the heating resistor 42*a* is developed in a manner earlier than expansion (swelling) process of ink bubbles B4 formed on the heating resistor 42*b*. Thus, ink bubbles B3 having large volume are first formed. As a result, inks 4 are pressed toward the heating resistor 42*b* side to discharge ink droplets i from nozzles 44*a* toward the heating resistor 42*b* side of width direction W of the recording paper P.

Figure 22:
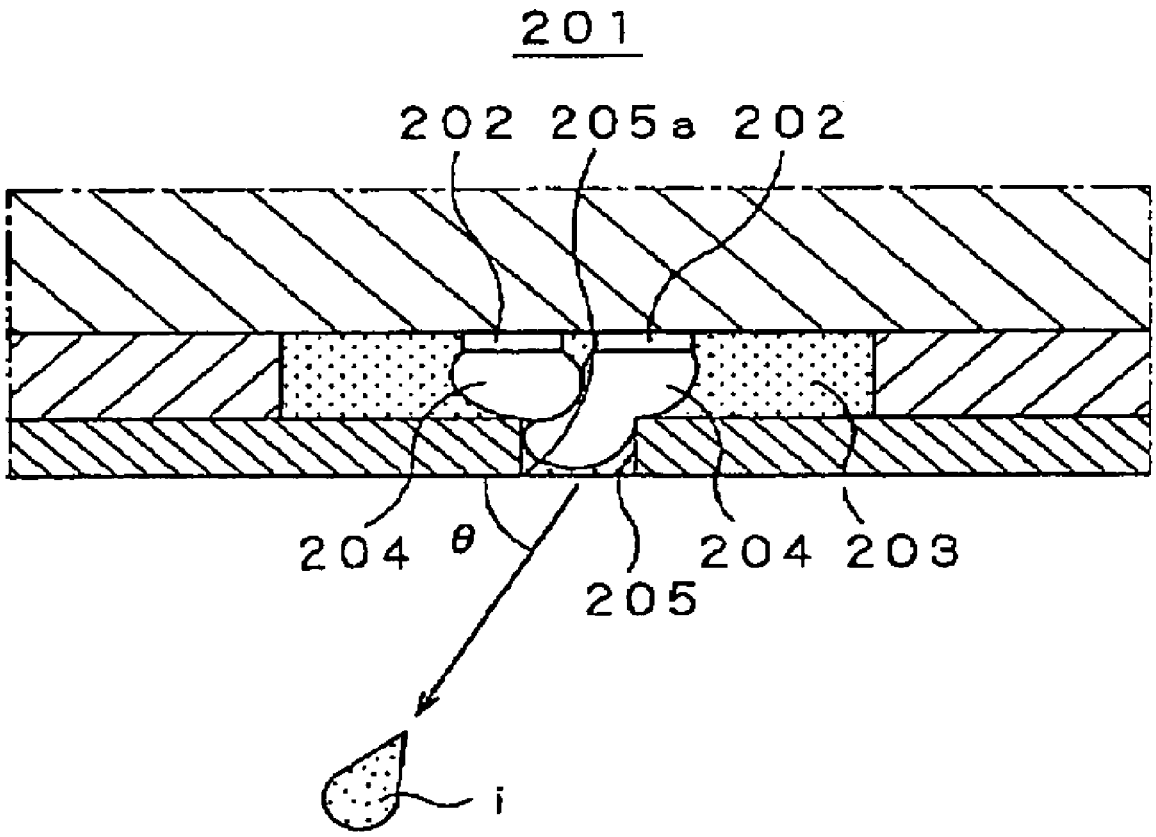
FIG.22 (PRIOR ART)
FIG. 22 is a cross sectional view showing, in a model manner, a conventional liquid discharge portion (element).

Here, according as shifts of ON timings of the switching elements 72*a*, 72*b* are reduced, difference between generation timings of bubbles on a pair of heating resistors 42*a*, 42*b* becomes small. Thus, discharge angle (see FIG. 22) of ink droplets i discharged from nozzles 44*a* with discharge surface 27*a* being as reference becomes large.

When there results less difference in expansion (swelling) process of ink bubbles B3, B4 formed on the pair of heating resistors 42*a*, 42*b*, volumetric difference between both bubbles is reduced. Thus, it is possible to discharge ink droplets i so that they are hit at closer position at the heating resistor 42*b* side with respect to impact point D when ink droplets i are discharged toward the portion substantially immediately below from the nozzle 44*a*.

On the other hand, according as shift between ON timings of the switching elements 72*a*, 72*b* becomes large, difference between generation timings of bubbles on the pair of heating resistors 42*a*, 42*b* becomes large. As a result, discharge angle (see FIG. 22) of ink droplets i discharged from the nozzles 44*a* with the discharge surface 27*a* being as reference is reduced. Namely, when difference between expansion (swelling) process of ink bubbles B3, B4 formed on the pair of heating resistors 42*a*, 42*b* becomes large, volume difference between both bubbles becomes large. Thus, it is possible to discharge ink droplets i so that they are hit at farther position at the heating resistor 42*b* side with respect to impact point D when ink droplets i are discharged toward the portion substantially below from nozzles 44*a*.

Further, at the discharge control unit 63, switching elements 72*a*, 72*b* are controlled by a switching control circuit 73 so that pulse current delivered to the heating resistor 42*a* is caused to be reference, and pulse current is delivered to the heating resistor 42*b* in the state where timing is shifted in a time of the range within 20% of the time period during which pulse current is delivered to the heating resistor 42*a* with respect to the timing at which pulse current is delivered to the heating resistor 42*a*.

Then, explanation will be given in connection with the case where the discharge control unit 63 controls the switching control circuit 73 in such a manner to first turn the switching element 72*b* ON to subsequently turn the switching element 72*a* ON in a delayed manner.

Figure 16C:
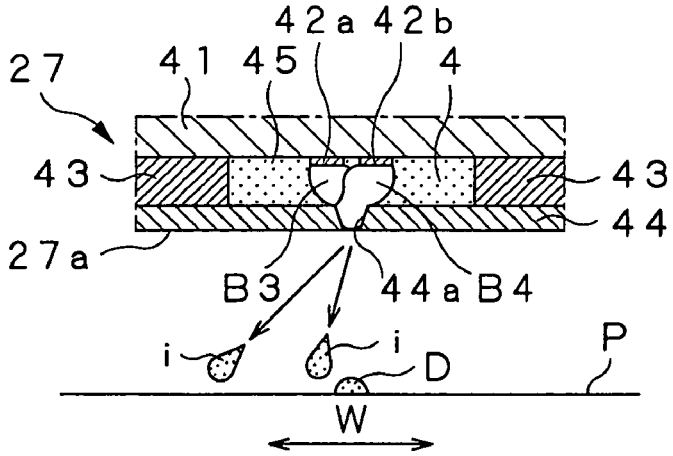

In this case, as shown in FIG. 16C, the discharge direction of ink droplets i can be varied toward the heating resistor 42*a* side of width direction W of the recording paper P. Namely, as the result of the fact that the switching element 72*b* is first brought into ON state, pulse current is delivered to the heating resistor 42*b* prior to the heating resistor 42*a*. As a result, bubbles are produced on the heating resistor 42*b* prior to production thereof on the heating resistor 42*a*. Further, expansion (swelling) process of ink bubbles B4 formed on the heating resistor 42*a* is developed in a manner earlier than expansion (swelling) process of ink bubbles B3 formed on the heating resistor 42*a*. Thus, ink bubbles B4 having large volume is first formed. As a result, inks 4 are pressed toward the heating resistor 42*a* side to discharge ink droplets i from nozzles 44*a* toward the heating resistor 42*a* side of width direction W of recording paper P. Here, according as shift between ON timings of switching elements 72*a*, 72*b* is reduced, difference between generation timings of bubbles on the pair of heating resistors 42*a*, 42*b* is reduced. Thus, discharge angle (see FIG. 22) of ink droplet i discharged from the nozzle 44*a* with the discharge surface 72*a* being as reference becomes large. This is similar to the case of FIG. 16B. Accordingly, when there results less difference in expansion (swelling) processes of ink bubbles B3, B4 formed on the pair of heating resistors 42*a*, 42*b* similarly to the case of FIG. 16B, volume difference between both bubbles becomes small. As a result, it is possible to discharge ink droplets i so that they are hit at nearer position at the heating resistor 42*b* side with respect to impact point D when ink droplets i are discharged toward the portion substantially immediately below from nozzles 44*a*.

On the other hand, similarly to the case of FIG. 16B, according as shift between ON timings of the switching elements 72*a*, 72*b* becomes large, difference between generation timings of bubbles on the pair of heating resistors 42*a*, 42*b* becomes large. As a result, discharge angle (see FIG. 22) of ink droplet i discharged from nozzle 44*a* with the discharge surface 27*a* being as reference becomes small. Namely, when difference between expansion (swelling) processes of ink bubbles B3, B4 formed on the pair of heating resistors 42*a*, 42*b* becomes large, volume difference between both bubbles becomes large. As a result, it is possible to discharge ink droplets i so that they are hit at farther position at the heating resistor 42*a* side with respect to impact point D when ink droplets i are discharged toward the portion immediately below from the nozzles 44*a*.

Further, at the discharge control unit 63, switching elements 72*a*, 72*b* are controlled by the switching control circuit 73 so that pulse current delivered to the heating resistor 42*b* is caused to be reference, and pulse current is delivered to the heating resistor 42*a* in the state where timing is shifted in a time of the range within 20% of time period during which pulse current is delivered to the heating resistor 42*b* with respect to timing at which pulse current is delivered to the heating resistor 42*b*.

In a manner as stated above, at the discharge control unit 63, timings of ON/OFF operations of switching elements 72*a*, 72*b* are controlled by the switching control circuit 73, thereby making it possible to change discharge direction from nozzles 44*a* of ink droplets i toward a direction in which a pair of heating resistors 42*a*, 42*b* are provided in parallel, i.e., width direction W of the recording paper P.

Figure 17:
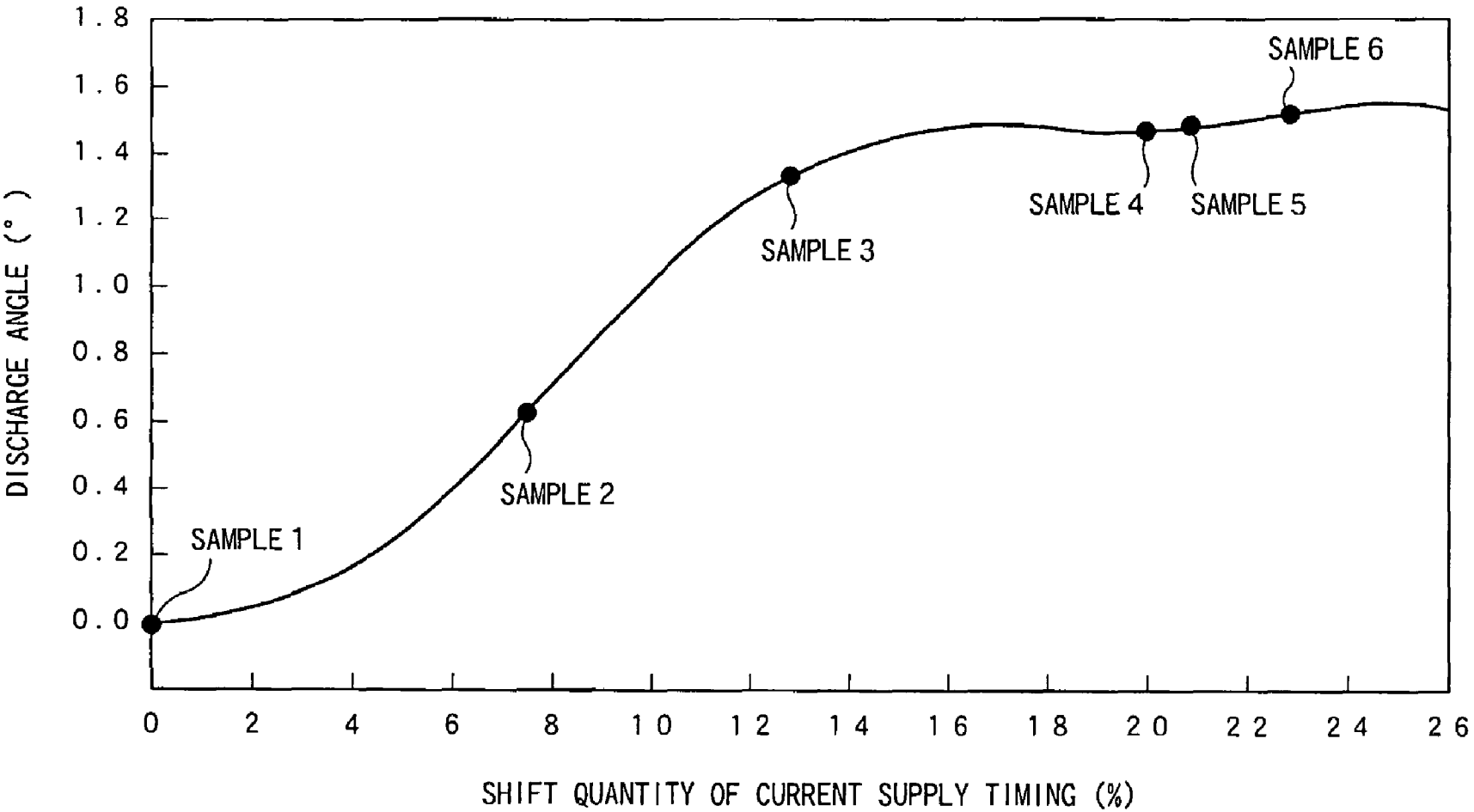
FIG. 17 is a characteristic diagram showing the relationship between shift quantity of current supply timing of a pair of heating resistors which constitute the ink discharge head and discharge angle.
Figure 18A:
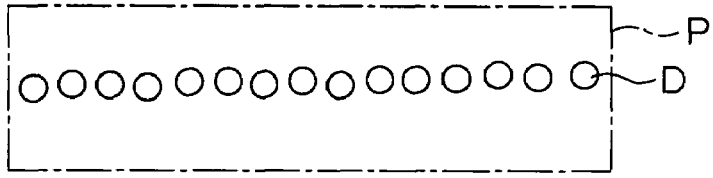
Figure 18B:
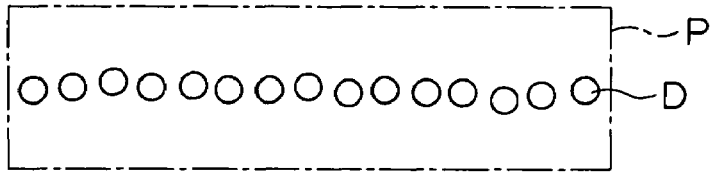
Figure 18C:
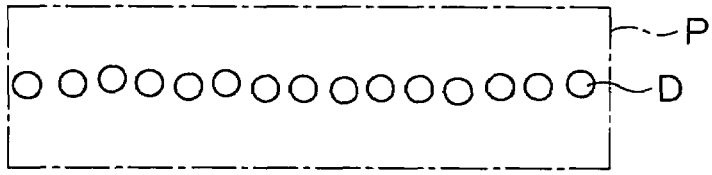
Figure 18D:
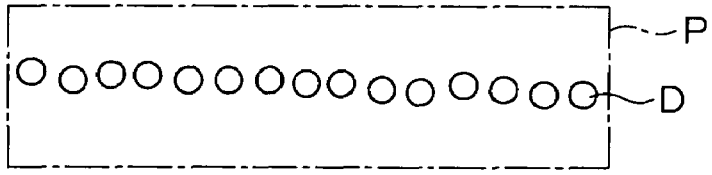
Figure 18E:
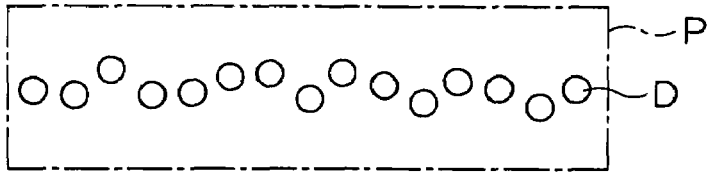
Figure 18F:
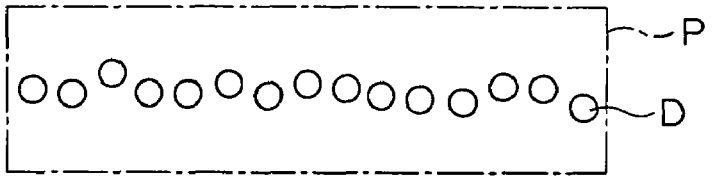

Here, measurement result of discharge angle of the ink droplet i when pulse current is delivered to the heating resistor 42*b* in the state where timing is shifted (delayed) with respect to the heating resistor 42*a* with the time point when ink droplets i are discharged toward the portion immediately below from the nozzle 44*a* being as reference is shown in FIG. 17.

In FIG. 17, shift quantity of supply timing of pulse current delivered to the heating resistor 42*b* is shown on the abscissa. In concrete terms, what percentage timing at which pulse current is delivered to the heating resistor 42*b* is shifted in point of time with timing at which pulse current is delivered to the heating resistor 42*a* being as reference is shown.

In FIG. 17, discharge angle when discharge is made in the state where discharge direction is changed with the time at which ink droplets i are discharged toward the portion substantially below from nozzles 44*a* is shown on the ordinate. In FIG. 17, unlike FIG. 22, it is indicated that discharge angle when ink droplets i are hit toward the portion substantially immediately below is set to 0°, and according as discharge angle is greatly shifted toward the heating resistor 42*b* side so that ink droplets i are discharged, discharge angle becomes great. For measurement of the discharge angle, there is used ink discharge head 27 in which thickness of the nozzle sheet is caused to be about 13μ and the diameter of nozzle 44*a* is caused to be about 17 μm.

From the measurement result shown in FIG. 17, it is understood that supply timings of pulse currents with respect to a pair of heating resistors 42*a*, 42*b* are shifted so that discharge direction of ink droplets i discharged from nozzles 44*a* are changed. In concreter terms, it is understood that when pulse current is delivered to the heating resistor 42*b* at a later (delayed) timing as compared to the heating resistor 42*a*, ink droplets i are discharged toward the heating resistor 42 side.

Moreover, in FIG. 17, impact points D in which ink droplets i discharged from nozzles 44*a* are hit upon recording paper P when shift quantities of supply timings of the pulse current are 0%, 7.5%, 13%, 20%, 21%, 23% are caused to be samples 1 to 6. Further, the states of impact points D of these samples 1 to 6 are shown in FIGS. 18A to 18F.

From evaluation results shown in FIGS. 18A to 18F, in samples 1 to 4 in which ink droplets i are discharged toward the heating resistor 42*b* in the state where supply timing of pulse current is delayed in the range within 20% of supply time of pulse current of the heating resistor 42*a* with respect to supply timing of pulse current to the heating resistor 42*a*, there is no unevenness at impact points D of ink droplets i even after the discharge direction has been changed. Accordingly, it is understood that ink droplets i are discharged from nozzles 44*a* at a predetermined discharge angle.

Particularly, in samples 2 to 4 in which ink droplets i are discharged toward the heating resistor 42*b* in the state where supply timing of pulse current is delayed within the range from 7.5% to 20% of supply time of pulse current of the heating resistor 42*a* with respect to supply timing of pulse current to the heating resistor 42*a*, change quantity of discharge angle with respect to shift quantity of supply timing of pulse current is large. From this fact, the shift quantity of supply timing of pulse current is caused to be within the range from 7.5% to 20%, thereby making it possible to stably perform control of the discharge direction.

It is understood that in the range where shift quantity of supply timing of pulse current is above 20% (samples 5 and 6), unevenness takes place in impact points D of ink droplets i.

This is because it is considered that when shift quantity of supply timing of pulse current is above 20%, balance of expansion (swelling) process of ink bubbles formed on a pair of heating resistors 42*a*, 42*b* is destroyed, and ink bubbles produced earlier resultantly become too larger than ink bubbles produced later so that pressing state of ink 4 by ink bubbles becomes unstable, and unevenness takes place in discharge direction of ink droplets i discharged from nozzles 44*a*.

Moreover, it is also considered that when shift quantity of supply timing of pulse current is above 20%, discharge direction of ink droplet i discharged from nozzle 44*a* becomes too oblique, so ink droplet i comes into contact with the edge of nozzle 44*a* when ink droplet i is discharged from nozzle 44*a* so that unevenness takes place in discharge direction. Accordingly, in the case of the samples 5 and 6, since impact points D of ink droplets i are varied, picture quality is lowered.

From facts as described above, in varying discharge direction of ink droplet i discharged from nozzle 44*a*, if control is made such that shift quantity of supply timing of pulse current is caused to fall within 20% to deliver pulse current to the heating resistor 42*b*, i.e., if supply timing of pulse current to the heating resistor 42*b* is delayed in the range within 20% of supply time of pulse current of the heating resistor 42*a* relative to supply timing of pulse current to the heating resistor 42*a*, there is no unevenness in discharge direction of ink droplet i so that impact position of ink droplet i can be stabilized. It is understood that this is vey important from a viewpoint of stabilizing impact position of ink droplet i.

Accordingly, in the above-described discharge control unit 63, the switching control circuit 73 controls ON/OFF operations of switching elements 72*a*, 72*b* so that when the discharge direction is varied to discharge ink droplet i from the nozzle 44*a*, pulse current delivered to one of a pair of heating resistors 42*a*, 42*b* is caused to be reference, and supply timing of pulse current with respect to the other heating resistor is shifted, on the other hand, in a time of the range within 20% of supply time of pulse current serving as reference with respect to the supply timing of pulse current serving as reference. Thus, at the printer apparatus 1, it is possible to suppress unevenness of impact positions of ink droplet i discharged in the state where discharge direction is changed from nozzle 44*a*. As a result, color tone unevenness and/or white stripe can be prevented. Thus, print operation can be performed at excellent picture quality.

It is to be noted that while evaluation is made with timing at which pulse current is delivered to heating resistor 42*a* and supply time of pulse current being as reference in the evaluations shown in FIGS. 17 and 18, the present invention is not limited to such implementation, but, e.g., pulse current delivered to the heating resistor 42*b* may be caused to be reference. In this case, ON/OFF operations of switching elements 72*a*, 72*b* are controlled by the switching control circuit 73 so that supply timing of pulse current to the heating resistor 42*a* is shifted in the range within 20% of supply time of pulse current of heating resistor 42*b* relative to supply timing of pulse current to the heating resistor 42*b* at the discharge control unit 63.

Figure 14:
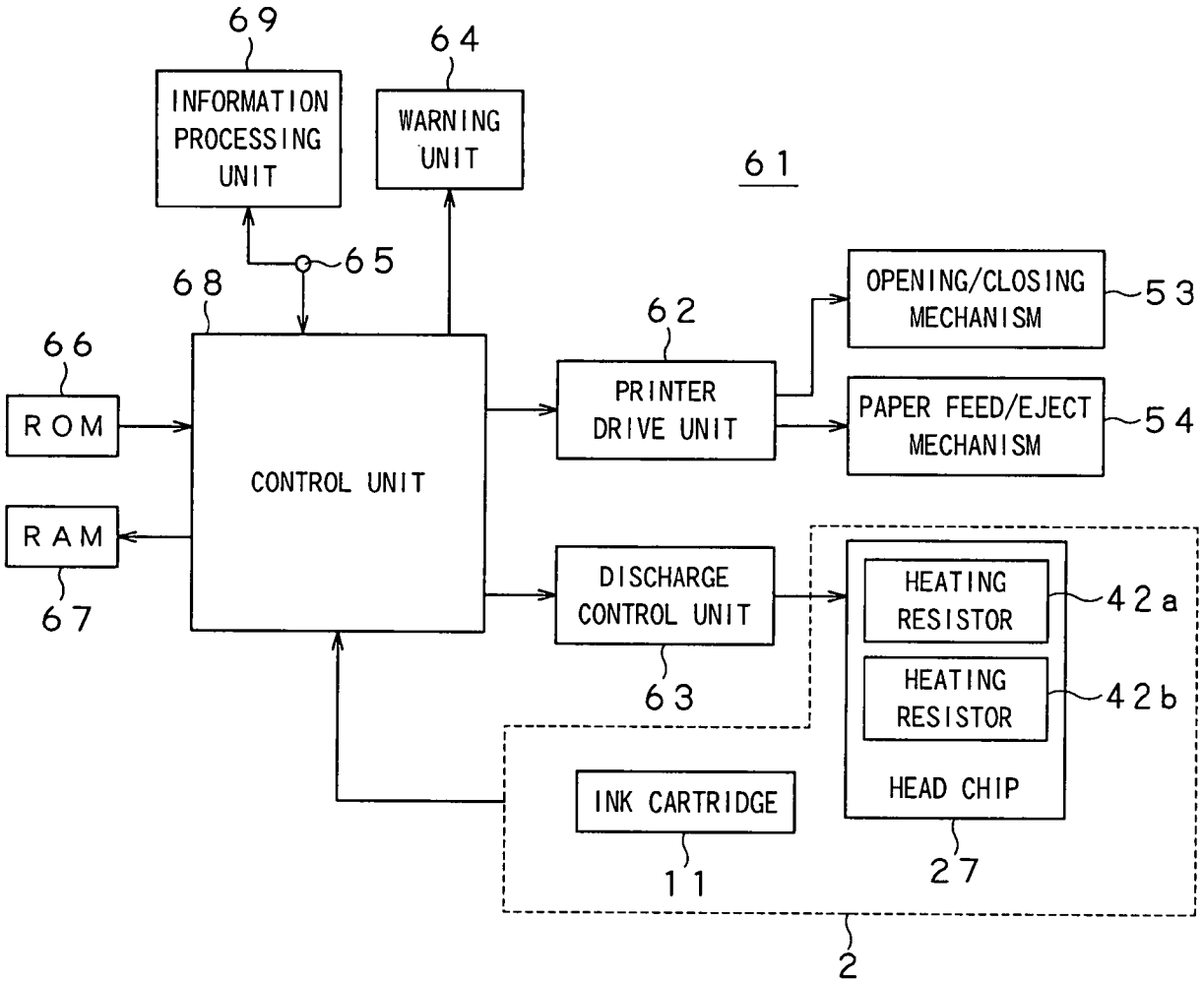
FIG. 14 is a block diagram showing a control circuit of the liquid discharge apparatus.

The warning unit 64 shown in FIG. 14 is display means, e.g., LCD (Liquid Crystal Display), etc. and serves to display information such as print condition, print state and/or ink remaining quantity, etc. Moreover, the warning unit 64 may be voice output means, e.g., speaker, etc. In this case, information such as print condition, print state and/or ink remaining quantity, etc. are outputted by voice. It is to be noted that the warning unit 64 may be caused to be of the configuration both including display means and audio output means. In addition, such warning may be performed by monitor or speaker, etc. of information processing equipment 69.

The input/output terminal 65 serves to transmit the above-described information such as print condition, print state and/or ink remaining quantity, etc. to external information processing unit 69, etc. through interface. Moreover, the input/output terminal 65 is supplied, from the external information processing unit 69, etc., with control signal for outputting the above-described information such as print condition, print state and/or ink remaining quantity, etc., and/or print data, etc. Here, the above-described information processing unit 69 is an electronic equipment, e.g., personal computer or PDA (Personal Digital Assistant), etc.

At the input/output terminal 65 connected to the information processing unit 69, etc., e.g., serial interface and/or parallel interface, etc. may be used as interface. In concrete terms, such interface is in conformity with the standard such as USB (Universal Serial Bus), RS (Recommended Standard) 232C, and/or IEEE (Institute of Electrical and Electronic Engineers) 1394, etc. Moreover, the input/output terminal 65 may be adapted to perform data communication with the information processing equipment 69 in any form such as wire communication or wireless communication. In this case, there are IEEE802.11a, 802.11b, 802.11g, etc. as the wireless communication standard.

Network, e.g., Internet, etc. may intervene between the input/output terminal 65 and the information processing equipment 69. In this case, the input/output terminal 65 is connected to network, e.g., LAN (Local Area Network), ISDN (Integrated Service Digital Network), xDSL (Digital Subscriber Line), FTHP (Fiber To The Home), CATV (Community Antenna Television), BS (Broadcasting Satellite), etc. The data communication may be performed by various protocols such as TCP/IP (Transmission Control Protocol/Internet protocol), etc.

The ROM 66 is a memory, e.g., EP-ROM (Erasable Programmable Read-Only Memory), etc., and is adapted so that programs of respective processing that the control unit 68 performs are stored. The stored programs are loaded into the RAM 67 by the control unit 68. The RAM 67 stores programs which have been read out from the ROM 66 by the control unit 68, and/or various states of the printer apparatus 1.

The control unit 68 controls respective units on the basis of print data inputted from the input/output terminal 65 and/or remaining quantity data of ink 4 inputted from the head cartridge 2, etc. The control unit 68 reads out, from the ROM 66, processing programs for controlling respective units on the basis of an inputted control signal, etc. to store those programs into the RAM 67 to perform controls and/or processing of respective units on the basis of the processing programs.

Namely, the control unit 68 controls the discharge control unit 63 on the basis of processing programs, etc. stored in the ROM 66, etc. in such a manner to allow, e.g., pulse current delivered to one of a pair of heating resistors 42*a*, 42*b* to be reference, and to shift, on the other hand, supply timing of pulse current to the other heating resistor in a time of the range within 20% of supply time of pulse current serving as reference with respect to supply timing of pulse current serving as reference so that discharge directions of ink droplets i discharged from nozzles 44*a* are not varied.

It is to be noted that while processing programs are stored into the ROM 66 in the control circuit 61 constituted as stated above, media for storing processing program are not limited to ROM 66, but various recording media, e.g., optical disc, magnetic disc, magneto-optical disc and/or IC card where processing programs are recorded, etc. may be used. In this case, the control circuit 61 may be caused to be of the configuration in which the control circuit 61 is connected, directly or through the information processing unit 69, to drive units for driving various recording media to read out processing programs from these recording media.

Figure 19:
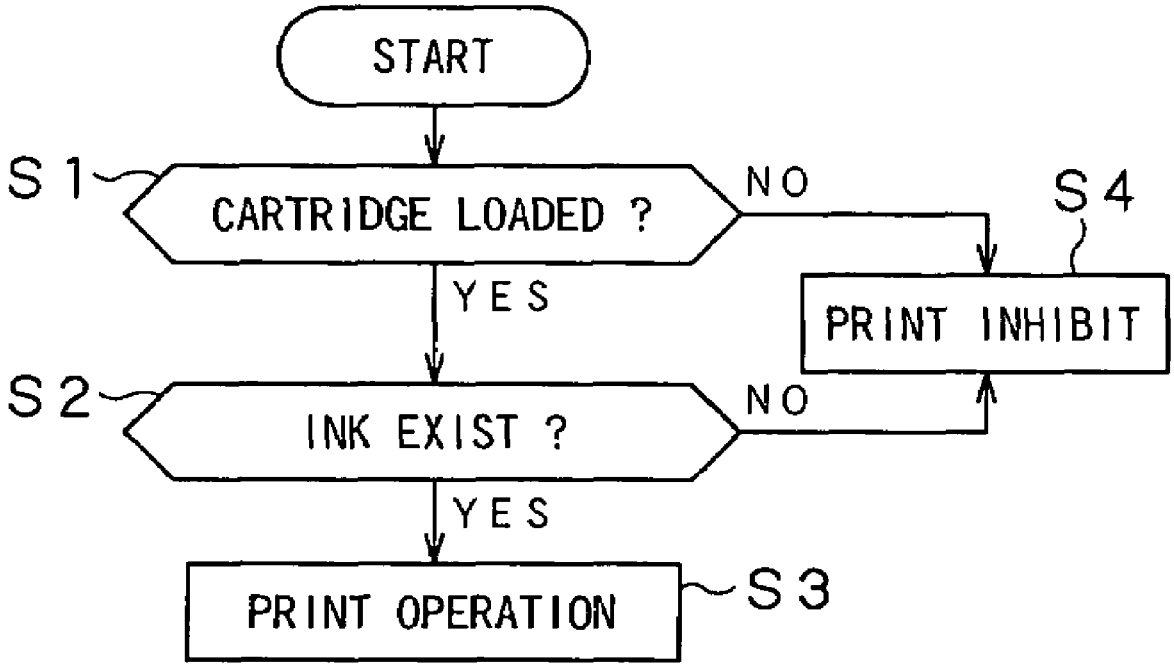
FIG. 19 is a flowchart for explaining print operation of the liquid discharge apparatus according to the present invention.

Here, the print operation of the printer apparatus 1 constituted as stated above will be explained with reference to the flowchart shown in FIG. 19. This operation is executed by arithmetic processing, etc. of CPU (Central Processing Unit) which is not shown within the control unit 68 on the basis of processing programs stored in memory means such as ROM 66, etc.

First, in order that the printer apparatus 1 performs print operation, user operates operation (console) panel, etc. provided at the printer body 3 to give instruction. Then, at step S1, the control unit 68 judges whether or not ink cartridges 11 of predetermined colors are loaded at respective loading portions 22. Further, when ink cartridges 11 of predetermined colors are suitably loaded into all loading portions 22, processing by the control unit 68 proceeds to step S2. When the ink cartridges 11 are not suitably loaded at the loading portion 22, processing by the control unit 68 proceeds to step S4 to inhibit print operation.

At step S2, the control unit 68 judges whether or not ink 4 within the connecting portion 26 is less than a predetermined quantity, i.e., is in inkless state. When it is judged that current state is inkless state, the control unit 68 warns that effect (fact) at the warning unit 64 to inhibit print operation at step S4. On the other hand, when ink within the connecting unit 26 is the predetermined quantity or more, i.e., ink 4 is filled, the control unit 68 permits print operation at step S3.

Figure 20:
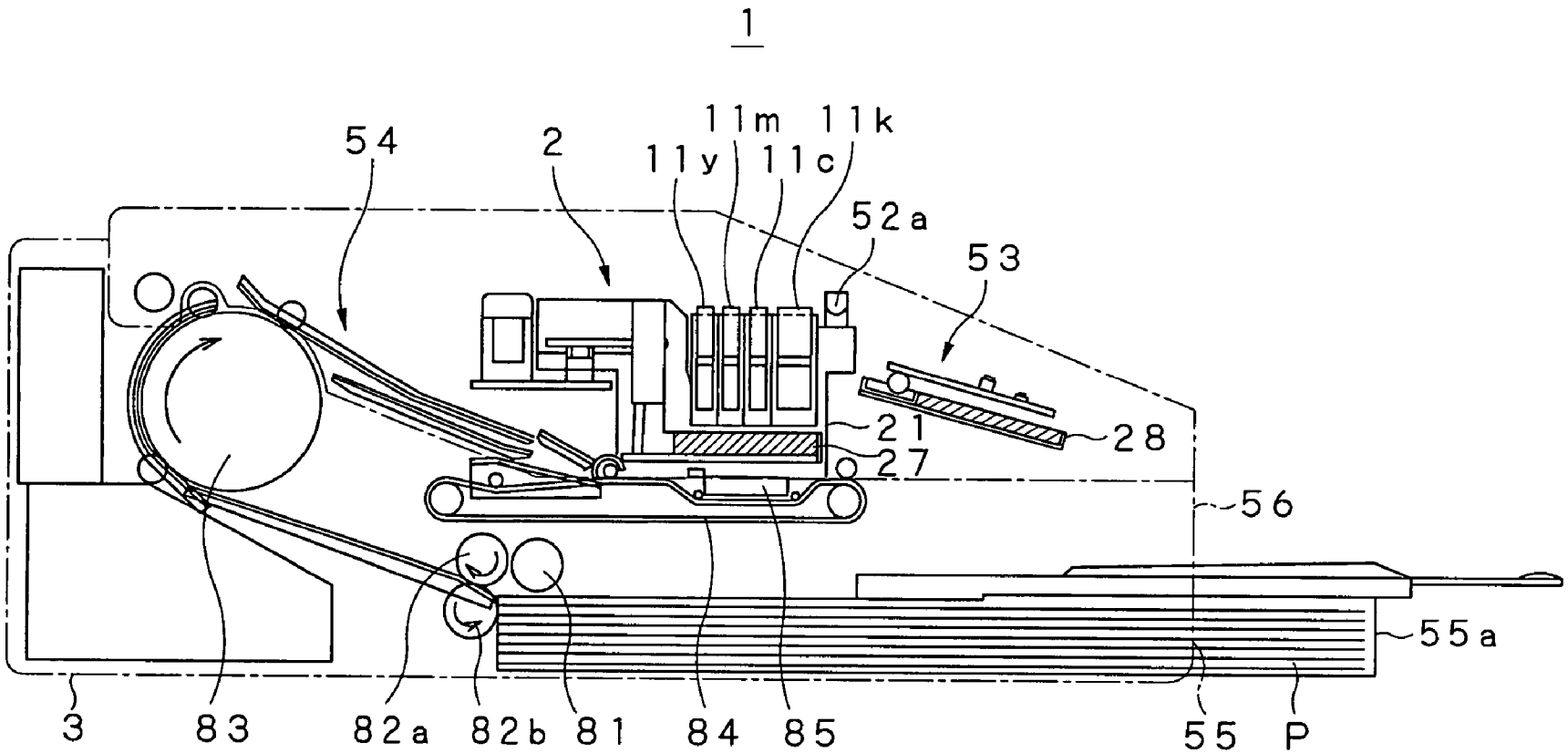
FIG. 20 is a side view partially perspectively showing the state where head cap opening/closing mechanism is opened in the liquid discharge apparatus according to the present invention.

In performing print operation, the control unit 68 performs drive control of respective drive mechanisms 53, 54 by the printer control unit 62 to move the recording paper P up to the position where the recording paper P can be printed. In concrete terms, as shown in FIG. 20, the control unit 68 drives drive motor constituting head cap opening/closing mechanism 53 to move head cap 28 toward tray 55*a* side with respect to the head cartridge 2 to allow nozzle 44*a* of the ink discharge head 27 to be exposed. Further, the control unit 68 drives drive motor which constitutes paper feed/eject mechanism 54 to travel recording paper P. In concrete terms, the control unit 68 pulls (takes) out recording paper P by paper feed roller 81 from tray 55*a* to carry one recording paper P which has been pulled (taken) out by a pair of separation rollers 82*a*, 82*b* rotating in directions opposite to each other to inverting roller 83 to invert the carrying direction thereafter to carry the recording paper P to carrying belt 84 to control paper feed/eject mechanism 54 in such a manner to allow holding means 85 to hold, at a predetermined position, recording paper P which has been carried to the carrying belt 84 so that position where ink 4 is to be hit is determined.

Further, when the control unit 68 confirms that the recording paper P has been held at the print position, it controls the discharge control unit 63 in such a manner to discharge ink droplets i toward the recording paper P from nozzles 44*a* of the ink discharge head 27. In concrete terms, as shown in FIG. 16A, in the case where ink droplets i are discharged toward the portion substantially immediately below from nozzles 44*a*, the discharge control unit 63 is controlled so that pulse currents having substantially the same current value are delivered to a pair of heating resistors 42*a*, 42*b* substantially at the same timing. Moreover, in the case where ink droplets i are discharged in the state where the discharge direction is changed toward the heating resistor 42*b* side from nozzles 44*a* as shown in FIG. 16B, the control unit 68 controls the discharge control unit 63 so that pulse current having substantially the same current value as that of pulse current delivered to the heating resistor 42*a* is delivered to the heating resistor 42*b* at timing later than timing at which pulse current is delivered to the heating resistor 42*a*. Further, in the case where ink droplets i are discharged in the state where the discharge direction is changed toward the heating resistor 42*a* side from nozzles 44*a* as shown in FIG. 16C, the control unit 68 controls the discharge control unit 63 so that pulse current having substantially the same current value as that of pulse current delivered to the heating resistor 42*b* is delivered to the heating resistor 42*a* at timing later than timing at which pulse current is delivered to the heating resistor 42*b*.

Further, when ink droplets i are discharged from nozzles 44*a* in the state where the discharge direction is changed, the control unit 68 controls the discharge control unit 63 so that pulse current delivered to one of a pair of heating resistors 42*a*, 42*b* is caused to be reference, and pulse current is delivered to the other heating resistor in the state where timing is shifted in a time of the range within 20% of supply time of pulse current serving as reference with respect to supply timing of pulse current serving as reference. Thus, at the ink discharge head 27, it is possible to suppress unevenness of impact positions of ink droplets i which have been discharged from nozzles 44*a* in the state where the discharge direction has been changed. Thus, it is possible to prevent color tone unevenness and/or white stripe.

As stated above, when ink droplets i are discharged from nozzles 44*a*, ink 4 having the same quantity as quantity where ink droplets i are discharged is immediately supplemented from the ink flow path 46 into the ink liquid chamber 45, the state returns to the original state as shown in FIG. 6B. When ink droplets i are discharged from the ink discharge head 27, the valve 34*e* which closes opening portion 34*d* of the ink chamber 34*b* by biasing force of the biasing member 34*f* and biasing force of diaphragm 34*i* is adapted so that in the case where negative pressure of ink 4 within the ink chamber 34*b* of the ink flow-out path 34*c* side divided into opening portion 34*d* is increased when ink droplets i are discharged from the ink discharge head 27 as shown in FIG. 6A, the diaphragm 34*i* is pushed up by negative pressure of the ink 4 and atmospheric pressure. As a result, the valve 34*e* is pushed up against biasing force of the biasing member 34*f* along with valve shaft 34*h*. At this time, the opening portion 34*d* between the ink flow-in path 34*a* side and the ink flow-out path 34*c* side of the ink chamber 34*b* is opened. As a result, ink 4 is delivered from the ink flow-in path 34*a* side toward the ink flow-out path 34*c* side. Thus, ink 4 is supplemented into ink flow path 46 of the ink discharge head 27. Further, negative pressure of ink 4 is lowered so that the diaphragm 34*i* returns to original form by restoring force to pull down the valve 34*e* along with the valve shaft 34*h* by biasing force of the biasing member 34*f* so that the ink chamber 34*b* is closed. In a manner as stated above, at the valve mechanism 34, when negative pressure of ink 4 is increased every time ink droplets i are discharged, the above-described operation will be repeated.

In a manner as stated above, characters and/or images corresponding to print data in order with respect to recording paper P traveling by the paper feed/eject mechanism 54. Further, the recording papers P in which print operation has been completed are ejected from paper eject hole 56 by the paper feed/eject mechanism 54.

As explained above, in the liquid discharge apparatus and the liquid discharge method according to the present invention, discharge control is performed so that when ink droplets are discharged from the nozzles in a manner to vary discharge direction, pulse current delivered to one of heating resistors is caused to be reference, and pulse current is delivered to the other heating resistor in the state where timing is shifted in a time of the range within 20% of supply time of pulse current serving as reference with respect to supply timing of pulse current serving as reference.

Thus, in the liquid discharge apparatus and the liquid discharge method according to the present invention, it is possible to prevent inconvenience such that when ink droplets are discharged from nozzles in the state where the discharge direction is changed, the discharge direction of ink droplets is varied, and/or inconvenience such that ink droplets come into contact with the edge of nozzles so that discharge direction is varied. As a result, it is possible to suppress unevenness of impact position of ink droplets discharged in the state where discharge direction has been varied from nozzles. Accordingly, in the liquid discharge apparatus and the liquid discharge method according to the present invention, since variation of impact positions is suppressed, deterioration of picture quality resulting from color tone unevenness and/or white stripe, etc. is prevented. Thus, print operation can be made at excellent picture quality.

In addition, in the liquid discharge apparatus and the liquid discharge method according to the present invention, since it is possible to prevent density unevenness of color and/or white stripe, etc. without provision of overlap portion at the time of print operation as in the prior art, time required for print operation is greatly reduced, thus making it possible to print image of high quality.

Figure 21A:
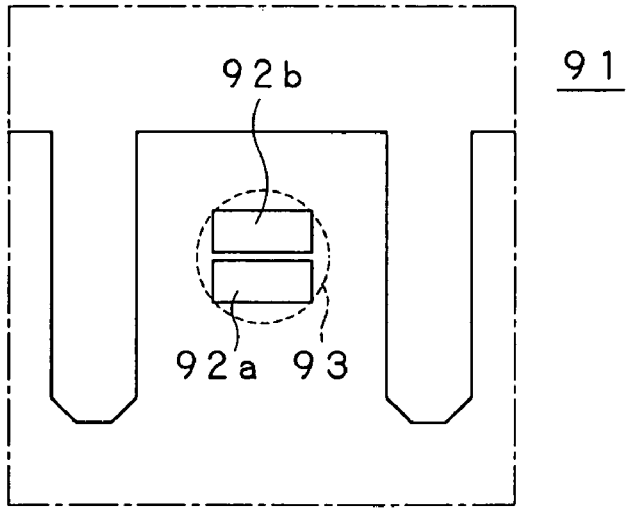
Figure 21B:
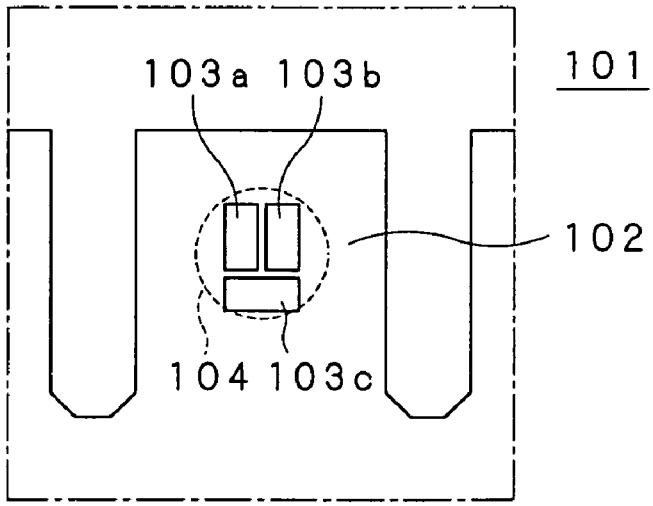
Figure 21C:
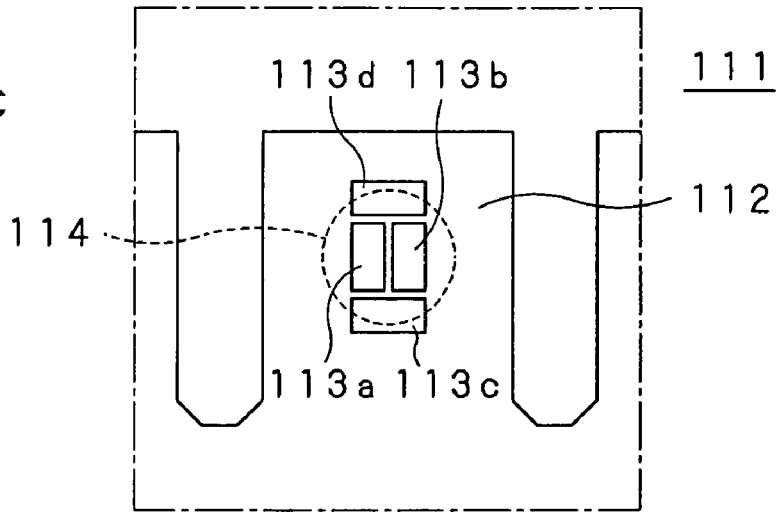

It is to be noted that explanation has been given in the above-mentioned description by taking, as an example, ink discharge head 27 in which pairs of heating resistors 42*a*, 42*b* are provided in parallel in width direction of recording paper P, the present invention is not limited to such a structure, but an ink discharge head adapted to control timings of pulse currents delivered to plural pressure generating elements to thereby have ability to change discharge direction of ink droplet i can be also applied to ink discharge heads 91, 101, 111 shown in FIGS. 21 to 21C, for example. In this case, the ink discharge head 91 is adapted so that a pair of heating resistors 92*a*, 92*a* are provided in parallel in carrying direction of recording paper P, the ink discharge head 101 is adapted so that three heating resistors 103*a*, 103*b*, 103*c* are disposed within the ink liquid chamber 102, and the ink discharge head 111 is adapted so that four heating resistors 113*a*, 113*b*, 113*c*, 113*d* are disposed within the liquid chamber 112.

The invention claimed is:

1. A liquid discharge apparatus comprising discharge control means including:

a liquid chamber for storing liquid;

first and second pressure generating elements provided at the liquid chamber, and serving to eject liquid stored within the liquid chamber;

discharge holes for discharging the liquid; and a discharge control means for controlling energy delivered to each one of the respective pressure generating elements in each of a first mode and a second mode, the first mode delivering energy to each one of the respective pressure generating elements at a substantially same timing in order to eject ink at a substantially perpendicular direction from an output surface of the discharge hole, and the second mode delivering substantially a same energy to each one of the respective pressure generating elements at different timings such that a second energy pulse delivered to the second pressure generating element is shifted a minimum of 7.5% and a maximum of 20% from a reference first energy pulse delivered to the first pressure generating element such that ink is discharged from the discharge hole at an angle offset from the perpendicular.

2. The liquid discharge apparatus as set forth in claim 1, wherein the discharge means is adapted so that the discharge holes are provided in parallel in substantially line form.

3. The liquid discharge apparatus as set forth in claim 1, wherein a third pressure generating element is provided at the liquid chamber, and said discharge control means delivers a third energy pulse in said second mode to said third pressure generating element shifted a minimum of 7.5% and a maximum of 20% from the reference first energy pulse delivered to the first pressure generating element.

4. The liquid discharge apparatus as set forth in claim 3, wherein a fourth pressure generating element is provided at the liquid chamber, and said discharge control means delivers a fourth energy pulse in said second mode to said fourth pressure generating element shifted a minimum of 7.5% and a maximum of 20% from the reference first energy pulse delivered to the first pressure generating element.

5. The liquid discharge apparatus as set forth in claim 1, wherein said discharge control means comprises a switch control circuit and a first and second switch respectively connected to said first and second pressure generating elements, wherein in said second mode, said switch control circuit delays the closing of said second switch from an open to a closed position at a minimum of 7.5% and a maximum of 20% relative to the closing of said first switch from an open to a closed position.

6. The liquid discharge apparatus as set forth in claim 1, wherein said discharge control means functions to prevent ink droplets discharged from said discharge holes from contacting an edge portion of the discharge hole and thereby resulting an unevenness of ink discharge angles.

7. A liquid discharge method for a liquid discharge apparatus including:

providing a liquid chamber for storing liquid;

providing first and second pressure generating elements provided at the liquid chamber, and serving to eject liquid stored within the liquid chamber;

providing discharge holes for discharging the liquid from the liquid chamber, providing a discharge control means for delivering energy to each one of the respective pressure generating elements in each of a first mode and a second mode, and delivering energy to each of the respective pressure generating elements in a first mode wherein substantially a same energy is delivered at substantially a same timing in order to eject ink at a substantially perpendicular direction from an output surface of the discharge hole, and delivering energy to each of the respective pressure generating elements in a second mode wherein substantially a same energy is delivered to each one of the respective pressure generating elements at different timings such that a second energy pulse delivered to the second pressure generating element is shifted a minimum of 7.5% and a maximum of 20% from a reference first energy pulse delivered to the first pressure generating element such that ink is discharged from the discharge hole at an angle offset from the perpendicular.

8. The liquid discharge method as set forth in claim 7, wherein the discharge holes are provided in parallel in substantially line form.

9. The liquid discharge method as set forth in claim 7, wherein a third pressure generating element is provided at the liquid chamber, and said discharge control means delivers a third energy pulse in said second mode to said third pressure generating element shifted a minimum of 7.5% and a maximum of 20% from the reference first energy pulse delivered to the first pressure generating element.

10. The liquid discharge method as set forth in claim 9, wherein a fourth pressure generating element is provided at the liquid chamber, and said discharge control means delivers a fourth energy pulse in said second mode to said fourth pressure generating element shifted a minimum of 7.5% and a maximum of 20% from the reference first energy pulse delivered to the first pressure generating element.

11. The liquid discharge method as set forth in claim 7, wherein said discharge control means comprises a switch control circuit and a first and second switch respectively connected to said first and second pressure generating elements, wherein in said second mode, said switch control circuit delays the closing of said second switch from an open to a closed position at a minimum of 7.5% and a maximum of 20% relative to the closing of said first switch from an open to a closed position.

12. The liquid discharge method as set forth in claim 7, wherein said discharge control means functions to prevent ink droplets discharged from said discharge holes from contacting an edge portion of the discharge hole and thereby resulting an unevenness of ink discharge angles.

* * * * *